US009517925B2

(12) United States Patent
Imai et al.

(10) Patent No.: US 9,517,925 B2
(45) Date of Patent: Dec. 13, 2016

(54) VALVE-INTEGRATING CONTAINER, LIQUID WITHDRAWING DEVICE EQUIPPED WITH THE SAME, AND METHOD FOR MANUFACTURING VALVE-INTEGRATING CONTAINER

(71) Applicant: SURPASS INDUSTRY CO., LTD., Saitama (JP)

(72) Inventors: Takashi Imai, Saitama (JP); Masahiro Hasunuma, Saitama (JP); Masamichi Kobayashi, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 0 days.

(21) Appl. No.: 14/941,223

(22) Filed: Nov. 13, 2015

(65) Prior Publication Data

US 2016/0145091 A1 May 26, 2016

(30) Foreign Application Priority Data

Nov. 21, 2014 (JP) ..... 2014-236896

(51) Int. Cl.
*B67D 7/36* (2010.01)
*B67D 7/02* (2010.01)
(Continued)

(52) U.S. Cl.
CPC ..... *B67D 7/36* (2013.01); *B65D 41/04* (2013.01); *B65D 47/06* (2013.01);
(Continued)

(58) Field of Classification Search
CPC ..... B67D 7/0294; B67D 7/36; B67D 7/0283; B67D 2210/0001; B67D 2210/00007; B65D 47/0809; B65D 41/04; B65D 51/1616; B65D 47/06; B01L 3/523
See application file for complete search history.

(56) References Cited

U.S. PATENT DOCUMENTS 2,820,579 A * 1/1958 Roth ..... B65B 3/305 141/353
7,841,492 B2 * 11/2010 Laible ..... B67D 3/0032 222/442

(Continued)

FOREIGN PATENT DOCUMENTS

JP S63-232127 A 9/1988

OTHER PUBLICATIONS

Partial European Search Report dated Mar. 31, 2016 from corresponding European Application No. 15194842.9; 6 pgs.

*Primary Examiner* — Frederick C Nicolas
(74) *Attorney, Agent, or Firm* — MH2 Technology Law Group, LLP

(57) ABSTRACT

The valve-integrating container includes a container body and a valve mechanism switching whether a liquid stored in the container body is allowed to flow out. The valve mechanism has a spring, a spring supporting part, and a valve plug. The spring supporting part has a liquid flow channel formed in a cylindrical shape extending along the axis, a lower end portion mounted to an internal threads of a reduced-diameter portion, an upper end portion projecting toward the enlarged-diameter portion, and a guide groove formed on a lower end side outer circumferential surface for guiding a liquid stored in a connecting portion downwardly. The valve plug has on its outer circumferential surface a guide groove guiding the liquid guided by the guide groove downwardly to an opening portion.

9 Claims, 16 Drawing Sheets

(51) Int. Cl.

| | |
|---|---|
| ***B65D 41/04*** | (2006.01) |
| ***B65D 47/06*** | (2006.01) |
| ***B65D 51/16*** | (2006.01) |
| *B65D 47/08* | (2006.01) |
| *B01L 3/00* | (2006.01) |

(52) U.S. Cl.
CPC ..... *B65D 51/1616* (2013.01); *B67D 7/0283* (2013.01); *B67D 7/0294* (2013.01); *B01L 3/523* (2013.01); *B65D 47/0809* (2013.01); *B67D 2210/0001* (2013.01); *B67D 2210/00007* (2013.01)

(56) References Cited

U.S. PATENT DOCUMENTS

| | | | | |
|---|---|---|---|---|
| 8,220,665 | B2 * | 7/2012 | Laible ..... | B67D 3/0032 222/181.1 |
| 2009/0159619 | A1 | 6/2009 | Laible | |
| 2014/0083557 | A1 | 3/2014 | George | |

* cited by examiner

VALVE-INTEGRATING CONTAINER, LIQUID WITHDRAWING DEVICE EQUIPPED WITH THE SAME, AND METHOD FOR MANUFACTURING VALVE-INTEGRATING CONTAINER

CROSS-REFERENCE TO RELATED APPLICATIONS

This application is based on Japanese Patent Application No. 2014-236896, the contents of which are incorporated herein by reference in its entirety.

TECHNICAL FIELD

The present disclosure relates to a valve-integrating container, a liquid withdrawing device equipped with the same, and a method for manufacturing the valve-integrating container.

BACKGROUND ART

In general, a liquid such as chemicals used for semiconductor manufacturing apparatuses and general chemicals is charged into a storage container at a production plant, and is then shipped with a cap attached to an opening portion formed on the storage container. It is known that a special cap with piping fixed thereto is attached to the opening portion for withdrawing the liquid stored in such a storage container (for example, refer to Japanese Unexamined Patent Application, Publication No. Sho 63-232127).

According to Japanese Unexamined Patent Application, Publication No. Sho 63-232127, the liquid stored in the storage container can be drawn up through the piping or withdrawn by supplying a gas for pumping out the liquid into the storage container.

SUMMARY

Technical Problem

When using the storage container disclosed in Japanese Unexamined Patent Application, Publication No. Sho 63-232127, the storage container filled with a liquid at a production plant is transported with a cap attached, thereto and the cap is removed to be replaced with the special cap at a site of use. Because the piping is installed to the special cap as it is, it requires a process of coupling itself to piping toward which the liquid is supplied at the site. For example, the process may involve attaching a plug to the piping installed to the special cap and coupling the plug to a socket attached to the piping toward which the liquid is supplied.

Thus, the technique disclosed in Japanese Unexamined Patent Application, Publication No. Sho 63-232127 requires a process of removing the cap of the storage container to replace the cap with the special cap and a process of attaching the plug to the piping installed, to the special cap before the liquid can be withdrawn.

The present disclosure has been made under such a circumference and an object of the present disclosure is to provide a downsized valve-integrating container which enables a liquid inside a container to be withdrawn easily and safely without leaving any residue, a liquid withdrawing device equipped with the same, and a method for manufacturing the valve-integrating container.

Solution to Problem

In order to solve the foregoing problem, the following solutions have been adopted in the present disclosure.

A valve-integrating container according to an aspect of the present disclosure includes: a container body formed in a cylindrical shape extending in an axial direction, the container body having an enlarged-diameter portion, a reduced-diameter portion provided below the enlarged-diameter portion, and a connecting portion connecting the enlarged-diameter portion and the reduced-diameter portion; and a valve mechanism mounted to the reduced-diameter portion of the container body and switching whether a liquid stored in the container body is allowed to flow out through a first opening portion provided at a lower end of the reduced-diameter portion, the valve mechanism including: a spring disposed along the axial direction; a spring supporting part supporting one end portion of the spring; and a valve plug disposed between the spring supporting part and the first opening portion and receiving a biasing force toward the first opening portion from an other end portion of the spring, the spring supporting part including: a liquid flow channel formed in a cylindrical shape extending along the axial direction; a lower end portion mounted to an inner circumferential surface of the reduced-diameter portion; an upper end portion projecting toward the enlarged-diameter portion; and a first guide groove formed on an outer circumferential surface thereof for guiding a liquid stored in the connecting portion downwardly in the axial direction, and the valve plug has a second guide groove formed on an outer circumferential surface thereof for guiding the liquid guided by the first guide groove, downwardly in the axial direction to the first opening portion.

According to a valve-integrating container in accordance with an aspect of the present disclosure, the valve mechanism switching whether the liquid stored in the container body is allowed to flow out is mounted to the reduced-diameter portion provided at a lower portion of the container body. The valve plug of the valve mechanism receives a biasing force from the spring in a direction toward the first opening portion, provided at the lower end of the reduced-diameter portion. The spring supporting part supporting the one end portion of the spring is mounted to the inner circumferential surface of the reduced-diameter portion at its lower end portion and projects toward the enlarged-diameter portion of the container body at its upper end portion. This shortens the length of the valve-integrating container in the axial direction to downsize it as compared with the case where the spring supporting part does not project toward the enlarged-diameter portion of the container body.

If the level of the liquid stored in the container body is higher than an upper end of the spring supporting part projecting toward the enlarged-diameter portion, the liquid is led to the first opening portion by the liquid flow channel formed in the spring supporting part. Meanwhile, if the level of the liquid stored in the container body is lower than the upper end of the spring supporting part projecting toward the enlarged-diameter portion, the liquid does not flow through the liquid flow channel formed in the spring supporting part.

Also, according to the valve-integrating container of this aspect, if the level of the liquid is lower than the upper end of the spring supporting part, the liquid stored in the connecting portion connecting the enlarged-diameter portion and the reduced-diameter portion of the container body is guided downwardly in the axial direction by the first guide groove formed on the outer circumferential surface of the spring supporting part. The liquid guided by the first guide groove will be led to the first opening portion by the second guide groove formed on the outer circumferential surface of the valve plug.

Also, according to the valve-integrating container of this aspect, by mounting the valve-integrating container to, for example, a server device having a projection portion moving the valve plug away from the first opening portion, the worker can easily and safely withdraw the liquid inside the container without touching the liquid.

Thus, according to the valve-integrating container of this aspect, there can be provided a downsized valve-integrating container which enables a liquid inside a container to be withdrawn easily and safely without leaving any residue.

A valve-integrating container according to an aspect of the present disclosure may be configured to include a filter part attached to an upper portion of the container body, the filter part letting a gas flow into and out of the container body while preventing a liquid from flowing into and out of the container body.

According to the configuration, because the filter part lets a gas flow into and out of the container body, a gas can be led into the container body from the outside for volume displacement of a liquid having flowed out through the first opening portion. In addition, a gas generated inside the container body, for example, is discharged to the outside, thereby avoiding high pressure inside the container body. Further, the filter part prevents a liquid or foreign matter having a particle diameter larger than that of a liquid from entering into the container body from outside while preventing a liquid from flowing out of the container body.

In the valve-integrating container of this configuration, the container body may include a cylindrical second opening portion provided above the enlarged-diameter portion, the second opening portion extending in the axial direction and carrying external threads on an outer circumferential surface thereof, and a cap carrying on an inner circumferential surface thereof internal threads to be fastened to the external threads formed on the second opening portion, and the filter part may be attached to the cap.

With this configuration, a liquid can be easily supplied, into the container body through the second opening portion, with the cap removed from the container body. Also, an easy operation of attaching the cap to the container body can make the filter part attached to the second opening portion.

In a valve-integrating container according to an aspect of the present disclosure, the enlarged-diameter portion may include a first enlarged-diameter portion integrally molded with the reduced-diameter portion and the connecting portion and a second, enlarged-diameter portion provided above the first enlarged-diameter portion, and an upper end of the first enlarged-diameter portion and a lower end of the second enlarged-diameter portion may be joined together by heat welding.

With this configuration, the container body can be formed by joining by heat welding a member prepared by integrally molding the reduced-diameter portion, the connecting portion, and the first enlarged-diameter portion, and a member forming the second enlarged-diameter portion. Accordingly, the container body can foe manufactured easily as compared with integrally molding all of the reduced-diameter portion, the connecting portion, and the enlarged-diameter portion as a single member.

A liquid withdrawing device according to an aspect, of the present disclosure includes any of the above valve-integrating containers, and a server device removably receiving the valve-integrating container and withdrawing the liquid stored in the valve-integrating container, the server device including: a recess into which the reduced-diameter portion of the container body is inserted; a projection portion contacting a tip portion of the valve plug when the reduced-diameter portion is inserted in the recess, to move the valve plug away from the first opening portion; and a locking mechanism establishing a locked state where the reduced-diameter portion is fixed to the recess in response to insertion of the reduced-diameter portion into the recess and establishing an unlocked state where the reduced-diameter portion is removable from the recess in response to an operator's unlocking operation.

According to the liquid withdrawing device of this aspect, the reduced-diameter portion of the container body is locked as it is fixed in the recess in response to insertion of any of the above valve-integrating container into the recess of the server device. Also, the tip portion of the valve plug of the valve-integrating container contacts the projection portion of the server device to be moved away from, the first opening portion, and thus the liquid stored in the valve-integrating container can be withdrawn through the first opening portion.

With this configuration, there can be provided, a liquid withdrawing device equipped with a downsized valve-integrating container which enables a liquid inside the container to be withdrawn easily and safely without leaving any residue.

A liquid withdrawing device according to an aspect of the present disclosure may be configured such that the recess of the server device has on an inner circumferential surface thereof groove portions extending in the axial, direction at a plurality of points around the axis, the reduced-diameter portion of the valve-integrating container has on an outer circumferential surface thereof projection portions extending in the axial direction at a plurality of points around the axis, a plurality of positions of the groove portions around the axis correspond to a plurality of positions of the projection portions around the axis, and the valve-integrating container is mounted to the server device by inserting the projection portions at the plurality of points into the groove portions at the plurality of points.

According to the configuration, if the plurality of positions of the groove portions around the axis do not correspond, to the plurality of positions of the projection portions around the axis, the projection portions at the plurality of points cannot be inserted into the groove portions at the plurality of points, thereby preventing the valve-integrating container from being mounted to the server device. Therefore, in situations in which there are a plurality of valve-integrating containers each containing a different liquid and their respective server devices, misconnection between the valve-integrating containers and the server devices can be prevented.

A method for manufacturing a valve-integrating container according to an aspect of the present disclosure includes the steps of: forming a lower end side container formed in a cylindrical shape extending in an axial direction and including a first enlarged-diameter portion, a reduced-diameter portion provided below the first enlarged-diameter portion, and a connecting portion connecting the first enlarged-diameter portion and the reduced-diameter portion; forming an upper end side container having a second enlarged-diameter portion at a lower portion thereof by cutting off a base portion from a container having a second opening portion at an upper end side and a base at a lower end side; joining by heat welding an upper-end of the first enlarged-diameter portion of the lower end side container to a lower end of the second enlarged-diameter portion of the upper end side container; mounting a valve mechanism switching whether a liquid is allowed to flow out through, a first opening portion provided at a lower end of the reduced-diameter portion, to the reduced-diameter portion of the lower end side container by inserting the valve mechanism through the second, opening portion; and fastening a cap carrying internal threads on an inner circumferential surface thereof to external threads provided on an outer circumferential surface of the second opening portion.

According to the method for manufacturing a valve-integrating container of this aspect of the present disclosure, the base portion is cut off from a container having the second, opening portion at the upper end side and the base at the lower end side, thereby forming the upper end side container having the second enlarged-diameter portion, at its lower portion. Thus, the upper end side container can be formed from a container of a commonly used shape.

Also, the upper end of the first enlarged-diameter portion of the lower end side container and the lower end of the second enlarged-diameter portion of the upper end side container are joined together by heat welding, and after that the valve mechanism is inserted through the second opening portion of the upper end side container to be mounted to the reduced-diameter portion of the lower end side container. This prevents the valve mechanism from contacting the heat source when joining the upper end side container to the lower end side container by heat welding. In addition, the valve mechanism is mounted to the lower end side container, the liquid is poured into the container body, and then the cap is fastened, and thus this seals the liquid in the valve-integrating container.

In addition, according to a method for manufacturing a valve-integrating container in accordance with an aspect of the present disclosure, there is provided a downsized valve-integrating container which enables a liquid inside a container to be withdrawn easily and safely without leaving any residue.

According to the present disclosure, there can be provided a downsized valve-integrating container which enables a liquid inside a container to be withdrawn easily and safely without leaving any residue, a liquid withdrawing device equipped with the same, and a method for manufacturing the valve-integrating container.

DESCRIPTION OF EMBODIMENTS

Hereinafter, a liquid withdrawing device 300 according to an embodiment of the present disclosure will be described with reference to drawings.

Figure 1:
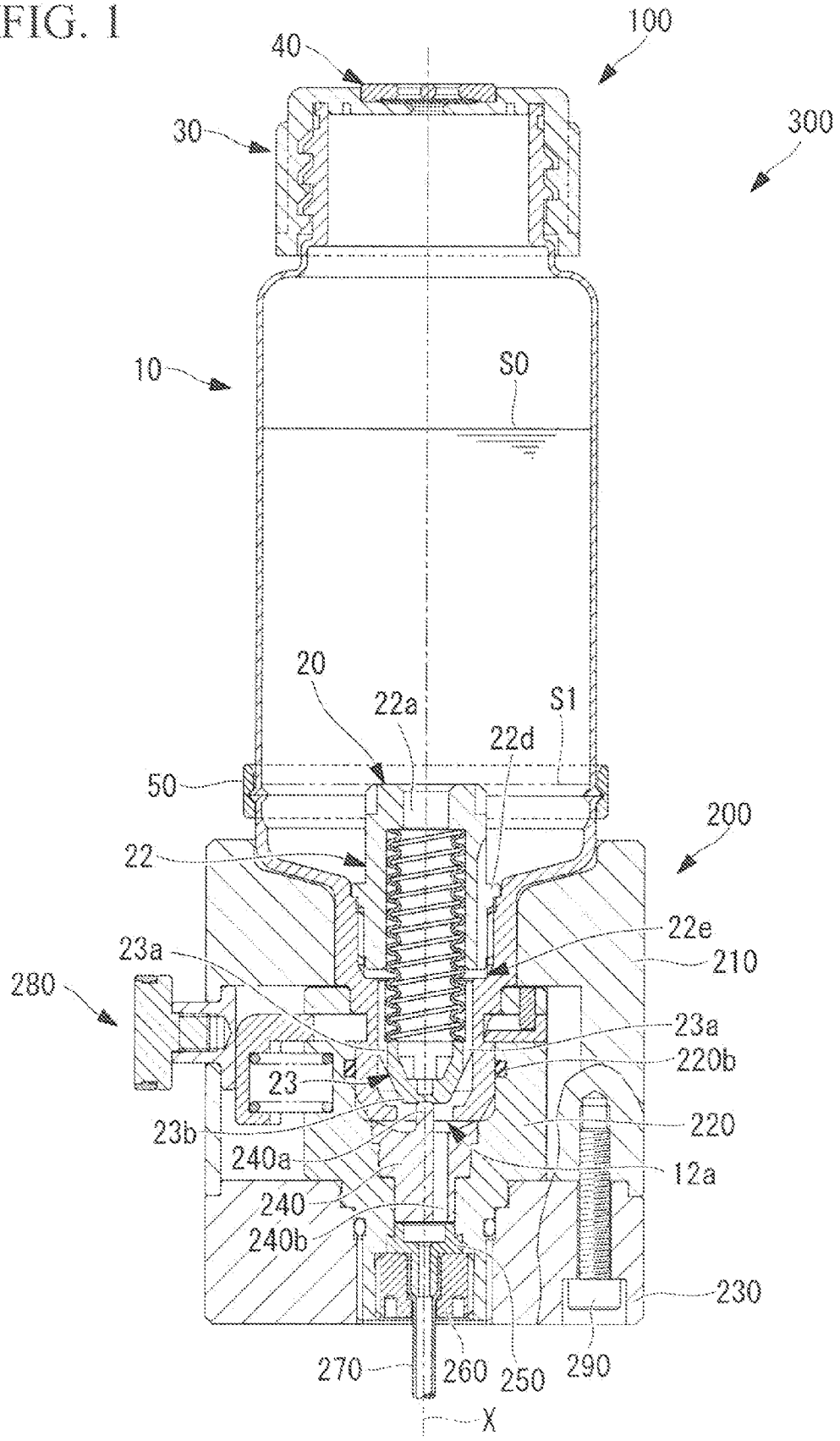
FIG. 1 is a vertical cross-sectional view showing a liquid withdrawing device of a first embodiment.

As shown in FIG. 1, the liquid withdrawing device 300 of the embodiment includes a valve-integrating container 100 and a server device 200. In the liquid withdrawing device 300 of the embodiment, the valve-integrating container 100 is mounted to the server device 200, and then a liquid stored in the valve-integrating container 100 is withdrawn to be supplied to the outside through the server device 200. The valve-integrating container 100 can store various kinds of liquids, such as chemicals used for semiconductor manufacturing apparatuses and general chemicals.

First, the valve-integrating container 100 of the embodiment will be described.

As shown in FIG. 1, the valve-integrating container 100 includes a container body 10, a valve mechanism 20, a cap 30, a filter part 40, and an identification ring 50.

Figure 2:
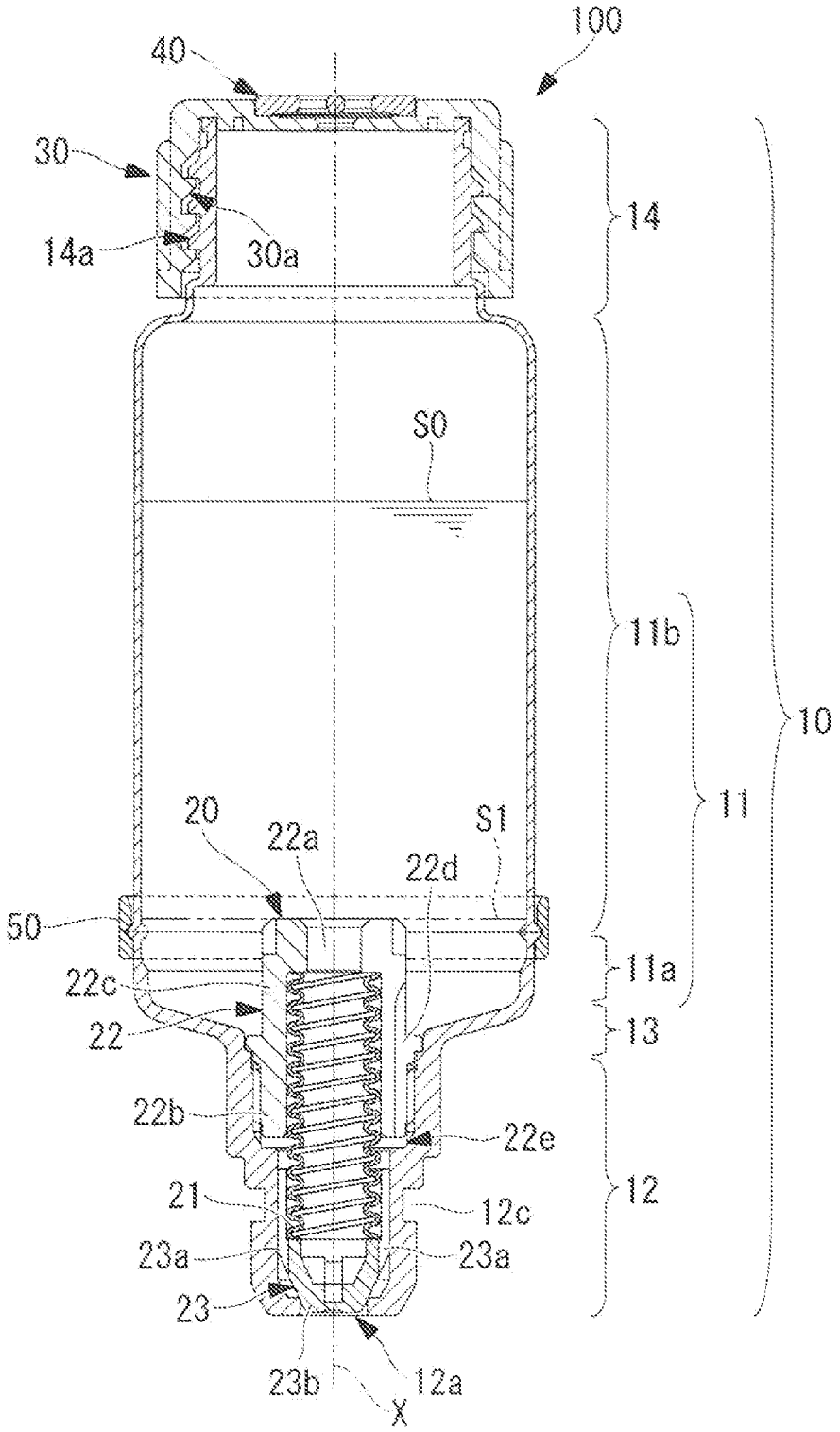
FIG. 2 is a vertical cross-sectional view snowing a valve-integrating container of the first embodiment.

As shown in FIG. 2, the container body 10 includes an enlarged-diameter portion 11, a reduced-diameter portion 12, a connecting portion 13, and an opening portion 14 (second opening portion), and stores a liquid inside. The container body 10 is formed in a cylindrical shape extending along an axis X. The reduced-diameter portion 12 is provided below the enlarged-diameter portion 11 and connected to the enlarged-diameter portion 11 by the connecting portion 13.

As shown in FIG. 2, the enlarged-diameter portion 11 includes a first enlarged-diameter portion 11*a* and a second enlarged-diameter portion 11*b* positioned upper than the first enlarged-diameter portion 11*a* along the axis X. The first enlarged-diameter portion 11*a* is integrally molded with the reduced-diameter portion 12 and the connecting portion 13 from a resin material (e.g., fluorine resin material). The first enlarged-diameter portion 11*a* and the second enlarged-diameter portion 11*b* are joined together by heat welding.

As shown in FIG. 2, the opening portion 14 is provided above the enlarged-diameter portion 11 and formed in a cylindrical shape extending along the axis X, and carries external threads 14*a* on its outer circumferential surface.

The valve mechanism 20 switches whether the liquid stored in the container body 10 is allowed to flow out through an opening portion 12*a* (first opening portion) provided at a lower end of the reduced-diameter portion 12 of the container body 10. As shown in FIG. 2, the valve mechanism 20 is mounted on an inner circumferential surface of the reduced-diameter portion 12 of the container body 10.

Figure 3:
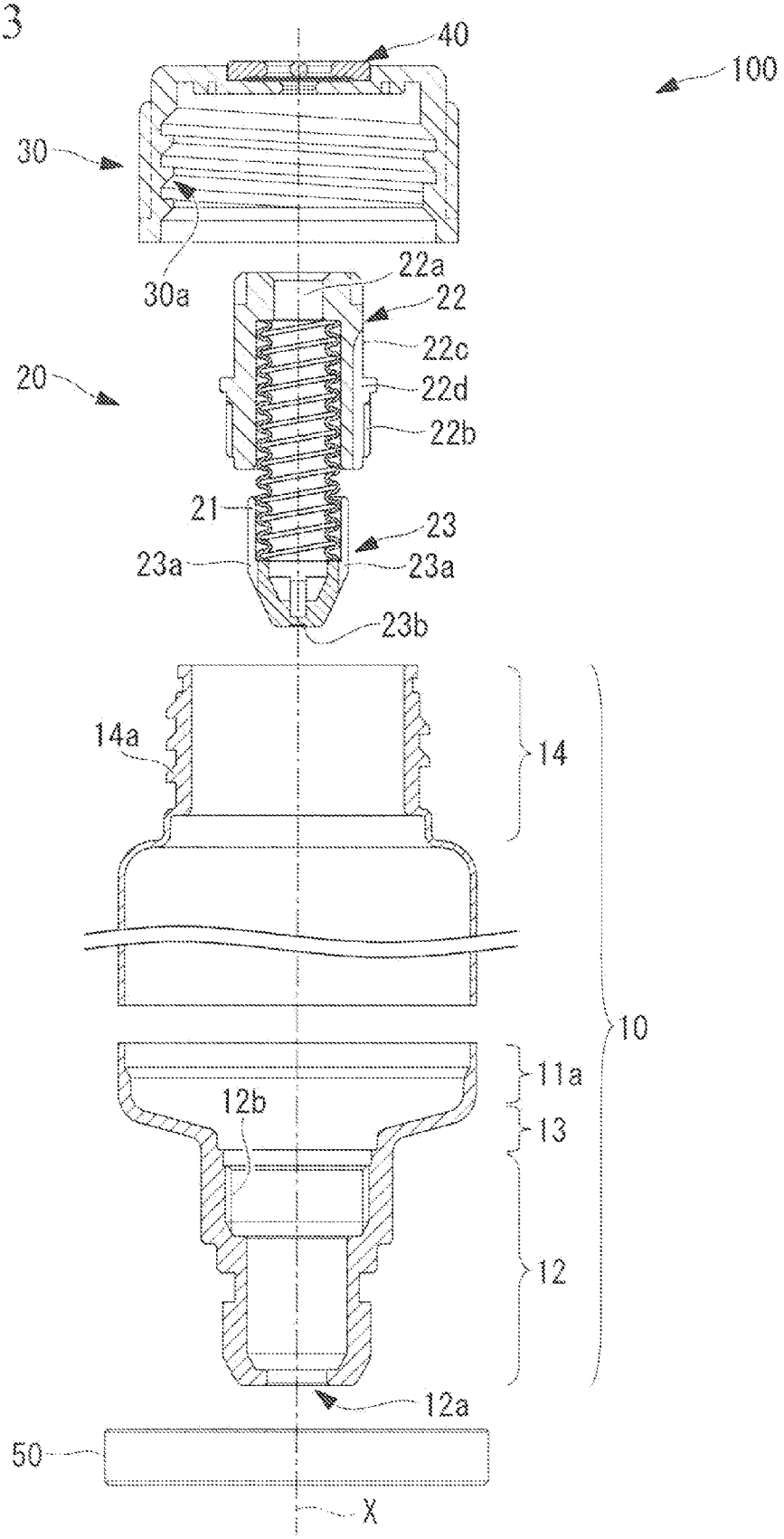
FIG. 3 is an exploded assembly view of the valve-integrating container shown in FIG. 2.

As shown in FIGS. 2 and 3, the valve mechanism 20 includes a spring 21, a spring supporting part 22, and a valve plug 23. Each part constituting the valve mechanism 20 is formed from a resin material (e.g., fluorine resin material). The spring 21 is an elastic member formed in a bellows shape which, is extendable along the axis X. The spring supporting part 22 supports one end portion 21*a* of the spring 21 provided along the axis X. The valve plug 23 is positioned between the spring supporting part 22 and the opening portion 12*a* and receives a biasing force from the other end portion 21*b* of the spring 21 in a direction toward the opening portion 12*a*.

The spring supporting part 22 of the valve mechanism 20 has a liquid flow channel 22*a* formed in a cylindrical shape extending along the axis X. The spring supporting part 22 carries external threads on an outer circumferential surface of its lower end portion 22*b*. The spring supporting part 22 is mounted to the reduced-diameter portion 12 as the external threads on the outer circumferential surface of the lower end portion 22*b* is fastened to internal threads 12*b* formed on the inner circumferential surface of the reduced-diameter portion 12 (refer to FIG. 3).

As shown in FIG. 2, an upper end portion 22*c* of the spring supporting part 22 is positioned to project toward the enlarged-diameter portion 11. As shown in FIGS. 2 and 3, the spring supporting part 22 has on its outer circumferential surface a guide groove 22*d* (first guide groove) for guiding the liquid stored in the connecting portion 13 of the container body 10 downwardly along the axis X.

The valve plug 23 of the valve mechanism 20 receives the biasing force from the other end portion 21*b* of the spring 21 in the direction toward the opening portion 12*a* to contact the opening portion 12*a*. As shown in FIG. 2, when a tip portion 23*b* of the valve plug 23 is in contact with the opening portion 12*a* of the container body 10, the liquid stored inside the container body 10 cannot be withdrawn through the opening portion 12*a*. On the other hand, when the tip portion 23*b* of the valve plug 23 is away from the opening portion 12*a* of the container body 10 as shown in FIG. 1, the liquid stored inside the container body 10 can be withdrawn through the opening portion 12*a*.

In a state shown in FIG. 2, the position of the tip portion 23*b* of the valve plug 23 on the axis X is the same with or higher than a lower end surface of the opening portion 12*a*. In the state shown in FIG. 2, the tip portion 23*b* of the valve plug 23 does not project downwardly through the opening portion 12*a* along the axis X, and accommodated in the reduced-diameter portion 12. Accordingly, the tip portion 23*b* of the valve plug 23 does not move away from the opening portion 12*a* in the state shown in FIG. 2, even when a plate-like member contacts the opening portion 12*a* or the opening portion 12*a* contacts a plane. Therefore, the liquid stored inside the container body 10 will not be withdrawn through the opening portion 12*a* even when a plate-like member contacts the opening portion 12*a* or the opening portion 12*a* contacts a plane.

As shown in FIGS. 2 and 3, the valve plug 23 has on its outer circumferential surface a guide groove 23*a* (second guide groove) for guiding the liquid guided from the connecting portion 13 of the container body 10 by the guide groove 22*d*, downwardly along the axis X to the opening portion 12*a*.

Figure 4:
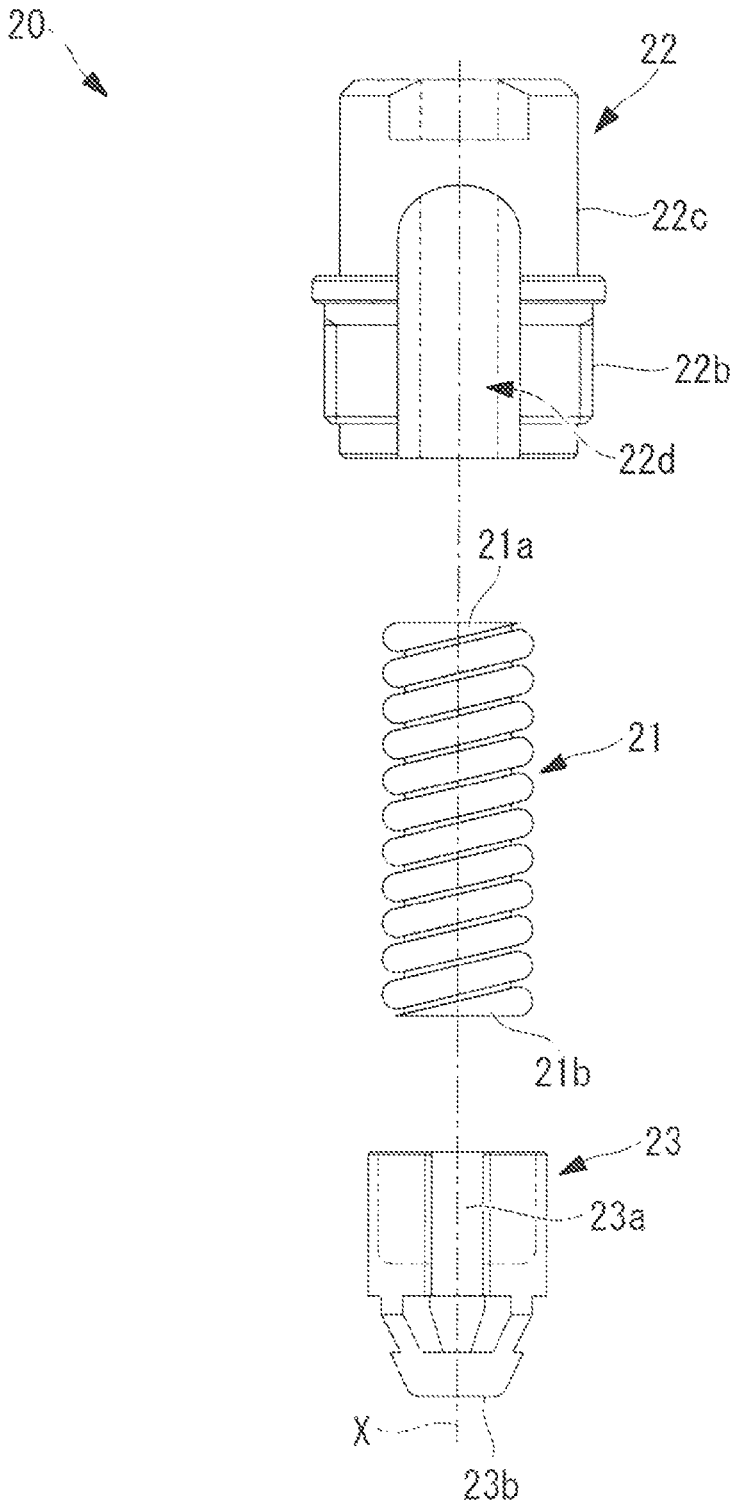
FIG. 4 is an exploded assembly view of a valve mechanism shown in FIG. 3.

As shown in the exploded assembly view of FIG. 4, the valve mechanism 20 is configured such that the spring 21 is accommodated in the spring supporting part 22 at the one end portion 21*a* and accommodated in the valve plug 23 at the other end portion 21*b*. The spring supporting part 22 and the valve plug 23 respectively have on their outer circumferential surfaces the guide groove 22*d* and the guide groove 23*a* each extending along the axis X. Here, FIG. 4 is a side view of the valve mechanism 20 shown in FIG. 2 as seen from the right.

Figure 5:
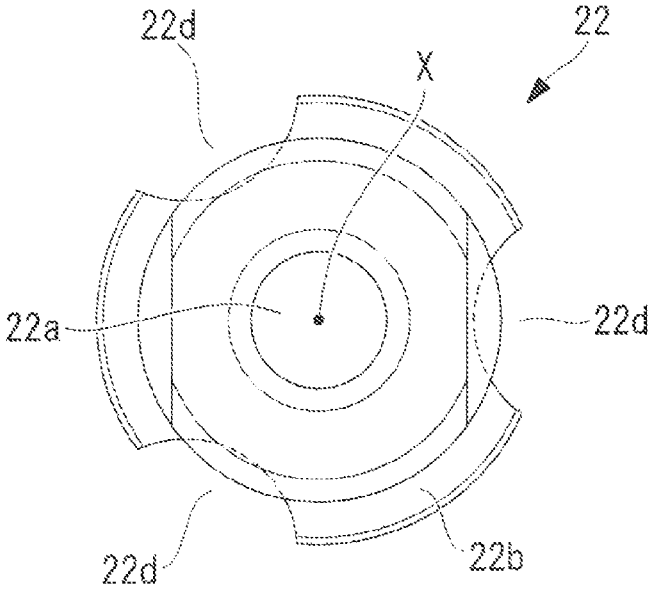
FIG. 5 is a plan view of a spring supporting part shown in FIG. 4 as seen from above in an axial direction.

As shown in FIG. 5, the guide groove 22*d* formed on the outer circumferential surface of the spring supporting part 22 is provided at three points around the axis X such that they are evenly spaced from each other. The three guide grooves 22*d* form flow channels through which the liquid flows between the inner circumferential surface of the reduced-diameter portion 12 and the spring supporting part 22 to lead the liquid stored in the connecting portion 13 downwardly.

Figure 6:
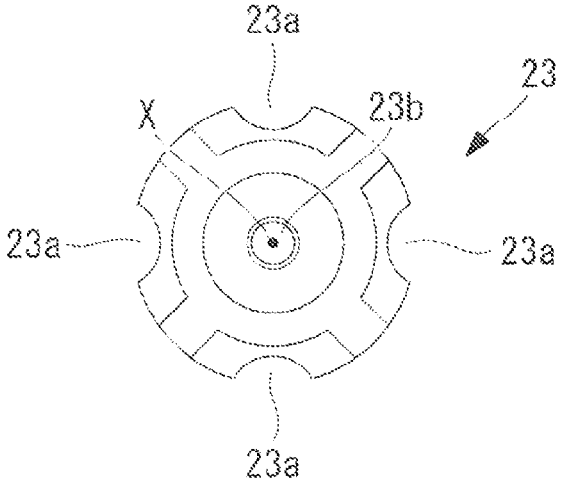
FIG. 6 is a plan view of a valve plug shown in FIG. 4 as seen from below in the axial direction.

As shown in FIG. 6, the guide groove 23*a* formed on the outer circumferential surface of the valve plug 23 is provided at four points around the axis X such that they are evenly spaced from each other. The four guide grooves 23*a* form flow channels through which the liquid flows between, the inner circumferential surface of the reduced-diameter portion 12 and the valve plug 23.

As shown in FIGS. 1 and 2, a clearance 22*e* is provided between an end of the spring supporting part 22 and the inner circumferential surface of the reduced-diameter portion 12, with the spring supporting part 22 fastened to the inner circumferential surface of the reduced diameter portion 12. The liquid led by the guide grooves 22*d* from the connecting portion 13 flows through the clearance 22*e* into the guide grooves 23*a* and will be led downwardly toward the opening portion 12*a*.

If a level of the liquid stored in the container body 10 is higher than S1 which corresponds to an upper end of the valve mechanism 20 as shown in FIG. 1 (e.g., the level S0 shown in FIG. 1), the liquid stored in the container body 10 is led through the liquid flow channel 22*a* of the spring supporting part 22 to the opening portion 12*a*. Meanwhile, if the level of the liquid stored in the container body 10 is lower than S1, the liquid is not led through, the liquid flow channel 22*a* to the opening portion 12*a*.

In the valve-integrating container 100 of the embodiment, the liquid stored in the container body 10 is led through the guide grooves 22*d* and the guide grooves 23*a* to the opening portion 12*a* whether the level of the liquid stored in the container body 10 is higher or lower than S1. Accordingly, even, when the level of the liquid declines below S1 and the liquid cannot be led through the liquid flow channel 22*a* of the spring supporting part 22 to the opening portion 12*a*, the liquid can be withdrawn to the outside without leaving any residue in the connecting portion 13. Meanwhile, when the level of the liquid is higher than S1 (e.g., the level S0 shown in FIG. 1), the liquid stored in the container body 10 is led to the opening portion 12*a* through the liquid flow channel 22*a*, as well as through the guide grooves 22*d* and the guide grooves 23*a*.

Although the liquid stored in the container body 10 is led to the opening portion 12*a* through the guide grooves 22*d* and the guide grooves 23*a* even if the liquid flow channel 22*a* is not provided and the upper end portion 22*c* of the spring supporting part 22 is blocked, it is advantageous to provide the liquid flow channel 22*a*. If the upper end portion 22*c* of the spring supporting part 22 is blocked, air bubbles lodge inside the spring supporting part 22. In contrast, air bubbles led into the spring supporting part 22 will be led to the container body 10 by providing the liquid flow channel 22*a* in the spring supporting part 22.

The cap 30 is attached to the opening portion 14 positioned at the upper portion of the container body 10. The cap 30 is attached to the container body 10 as internal threads 30*a* formed on an inner circumferential surface of the cap 30 is fastened to the external threads 14*a* formed on the outer circumferential surface of the opening portion 14. The filter part 40 is attached to the center of an upper end surface of the cap 30.

The filter part 40 lets a gas flow into and out of the container body 10, while preventing a liquid from flowing into and out of the container body 10. As shown in FIGS. 1 to 3, the filter part 40 is attached to the central portion of an upper end of the cap 30 attached to the upper portion of the container body 10.

Figure 7:
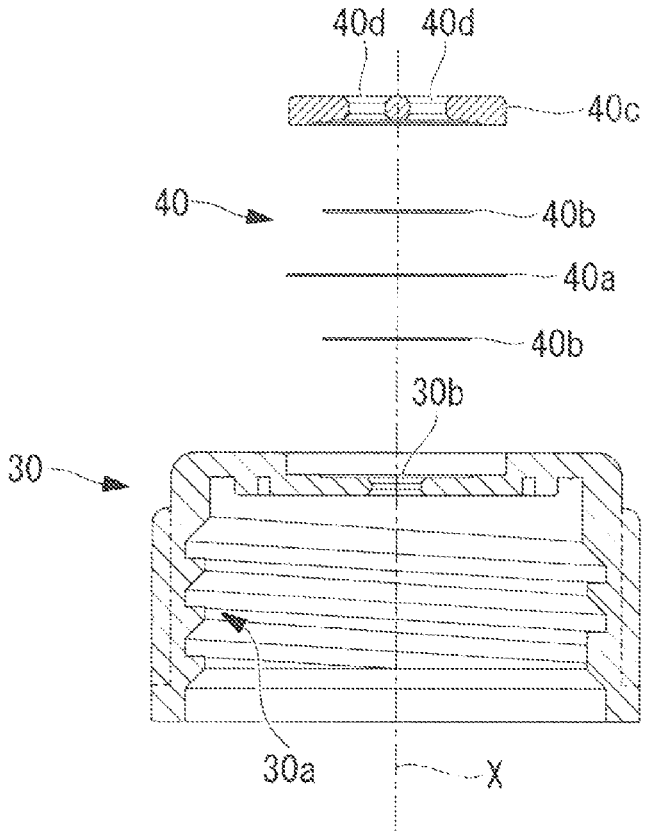
FIG. 7 is an exploded assembly view of a cap shown in FIG. 2.

As shown in the exploded assembly view of FIG. 7, the filter part 40 includes a membrane filter 40*a*, coarse filters 40*b*, and a lid portion 40*c*. The membrane filter 40*a* and the coarse filters 40*b* are thin films each having a circular shape in a plan view, and they are arranged such that the membrane filter 40*a* is sandwiched between the two coarse filters 40*b*. The membrane filter 40*a* and the coarse filters 40*b* are positioned as they are sandwiched between the central portion of the upper end surface of the cap 30 and the lid portion 40*c*.

The lid portion 40*c* is joined to the cap 30 by ultrasonic welding as it is attached to the cap 30. The membrane filter 40*a* and the coarse filters 40*b* are placed where the lid portion 40*c* and the cap 30 are ultrasonic welded together. As a result, a resin material melted toy the ultrasonic welding of the lid portion 40*c* and the cap 30 fixes the membrane filter 40*a* and the coarse filters 40*b*.

The membrane filter 40*a* is a porous thin film, formed from a fluorine resin, for example. By using a membrane filter 40*a* with a pore size of, for example, about 0.22 μm, foreign matter is prevented from mixing into the container body 10 from outside. Also, the membrane filter 40*a*, whose pore size is very small, has a property of preventing a liquid having a surface tension of a certain level or more from passing therethrough. In the embodiment, the pore of the membrane filter 40*a* is sized to prevent the liquid in the container body 10 from flowing out.

Meanwhile, the membrane filter 40*a*, which is porous, lets gas flow into and out of the container body 10. The coarse filters 40*b* are provided at both sides of the membrane filter 40*a* for preventing foreign matter from entering into the container body 10 due to deformation of the membrane filter 40*a* which might increase some pores in size.

Figure 8:
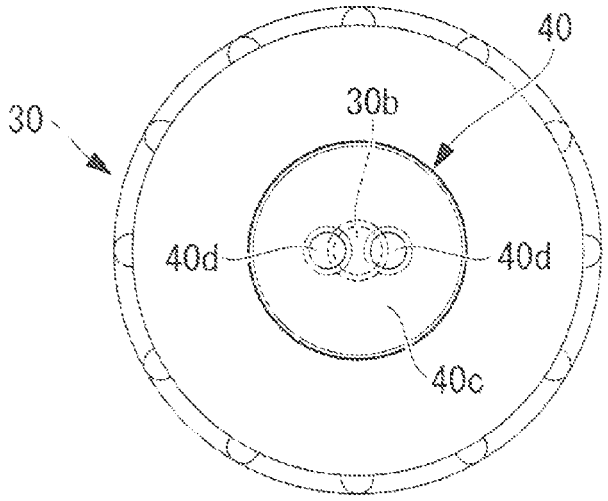
FIG. 8 is a plan view of the cap shown in FIG. 2 as seen from above in the axial direction.

The cap 30 has a vent 30*b* formed on its upper end surface. Also, the lid portion 40*c* has a vent 40*d* at two points thereof. As shown in the plan view of FIG. 8, a part of the vent 30*b* and parts of the vents 40*d* overlap with each other on a plane orthogonal to the axis X. Accordingly, a gas can flow into and out of the container body 10.

The identification ring 50 is an annular member attached to the joint obtained, by heat welding of the first enlarged-diameter portion 11*a* and the second enlarged-diameter portion 11*b*. The identification, ring 50 has on its inner circumferential surface an endless groove extending around the axis X. The identification ring 50 is attached to the container body 10 as the groove formed on the inner circumferential surface engages the bead portion formed by heat welding of the first enlarged-diameter portion 11*a* and the second enlarged-diameter portion 11*b*.

Next, the server device 200 will be described.

The server device 200 removably receives the valve-integrating container 100 and withdraws the liquid stored in the valve-integrating container 100.

As shown in FIG. 1, the server device 200 includes a first base member 210, a second base member 220, a third base member 230, a valve pressing member 240, a withdrawing member 250, a piping holding member 260, withdrawing piping 270, a locking-mechanism 280, and a fastening bolt 290.

The first base member 210 and the third base member 230 each have a square outline when viewed from above along the axis X. The first base member 210 has fastening holes carrying internal threads on its inner circumferential surface, at the four corners in a plan view. The third base member 230 has through holes at the four corners in a plan view such that the through holes correspond to the fastening holes of the first base member 210. As shown in FIG. 1, the first base member 210 and the third base member 230 are coupled to each other by inserting a fastening bolt 290 carrying external threads on its outer circumferential surface into the third base member 230 from below to fasten the fastening bolt 290 to the fastening hole of the first base member 210.

The second base member 220 is generally formed in a cylindrical shape extending along the axis X, and is fixed as it is sandwiched between the first base member 210 and the third base member 230. The second base member 220 carries external threads on its outer circumferential surface close to a lower end thereof, and the external threads is fastened to internal threads formed on an inner circumferential surface of third base member 230 around the axis X.

As shown in FIG. 3, an inner circumferential surface of the first base member 210 and an inner circumferential surface of the second base member 220 together form a recess 201, into which the reduced-diameter portion 12 of the container body 10 is inserted.

An endless groove portion extending around the axis X is formed on the inner circumferential surface of the second base member 220 forming the recess 201*f* and an O ring 220*b* is attached to the groove portion. As shown in FIG. 1, when the reduced-diameter portion 12 of the container body 10 is inserted in the recess 201, the O ring 220*b* contacts an outer circumferential surface of the reduced-diameter portion 12 to form a seal area along the entire circumference around the axis X.

As shown in FIG. 1, the valve pressing member 240, the withdrawing member 250, the piping holding member 260, and the withdrawing piping 270 are placed one under another in this order at the central position of the second base member 220 along the axis X.

The piping holding member 260 is generally formed in a cylindrical shape extending along the axis X and carries external threads on its outer circumferential surface. The piping holding member 260 is fixed to the second base member 220 as the external threads formed on the outer circumferential surface is fastened to internal threads formed on the inner circumferential surface of the second base member 220 around the axis X.

The withdrawing member 250 is inserted from above along the axis X into the piping holding member 260 with, the piping holding member 260 fixed to the third base member 230. The withdrawing member 250 has a liquid flow channel extending along the axis X at the center.

As shown in FIG. 1, the withdrawing piping 270 is fixed as sandwiched between the piping holding member 260 and the withdrawing member 250. As a result, the liquid led downwardly through the liquid flow channel formed in the withdrawing member 250 flows into the withdrawing piping 270. After the withdrawing member 250 is inserted into the second base member 220, the valve pressing member 240 is inserted over the withdrawing member 250. The valve pressing member 240 is fixed to the second base member 220 as it is press-fitted into the second base member 220.

The valve pressing member 240 has a projection portion 240*a* to press the tip portion 23*b* of the valve plug 23 upwardly along the axis X. When the reduced-diameter portion 12 is inserted in the recess 201, the projection portion 240*a* contacts the tip portion 23*b* of the valve plug 23 to move the valve plug 23 away from the opening portion 12*a*. As shown in FIGS. 2 and 3, a recessed portion which is circular when viewed in a plan view and into which the projection portion 240*a* of the valve pressing member 240 is inserted is formed at the central position of the tip portion 23*b* of the valve plug 23 on the axis X. The recessed portion guides the projection portion 240*a* such that the projection portion 240*a* reliably contacts the tip portion 23*b* and prevents, even if the projection portion 240*a* deviates from the axis X, a force acting to deform the projection portion 240*a*.

The valve pressing member 240 has liquid flow channels 240*b* penetrating therethrough in the direction of the axis X, at a plurality of points around the axis X. The liquid flowing out of the opening portion 12*a* will be led through the liquid flow channels 240*b* to the withdrawing member 250, with the valve plug 23 away from the opening portion 12*a*.

Next, the locking mechanism 280 of the server device 200 will be described using FIGS. 9 and 10.

The locking mechanism 280 establishes a locked state where the reduced-diameter portion 12 of the container body 10 is fixed to the recess 201 in response to insertion of the reduced-diameter portion 12 into the recess 201 and establishes an unlocked state where the reduced-diameter portion 12 is removable from the recess 201 in response to an operator's unlocking operation.

The locking mechanism 280 includes an unlocking button 281, a pressing member 282, a locking member 283, and a spring 284.

The unlocking button 281 receives the unlocking operation by the operator and connected to the pressing member 282. The unlocking button 281 and the pressing member 282 move from the position shown in FIG. 3 to the position shown in FIG. 10 when the operator performs the unlocking operation of pressing the unlocking button 281.

An identification ring 281*a* attached to the unlocking button 281 have the same color or pattern as that of the identification ring 50 attached to the container body 10, for example. The worker can recognize that a pair of a valve-integrating container 100 and a server device 200 with the same color or pattern is associated with each other. This prevents misconnection of the valve-integrating container 100 and the server device 200.

The locking member 283 is generally formed in a ring shape and is placed around the axis X. The locking member 283 has on its upper end surface an engaging groove 283*a* extending in a radial direction orthogonal to the axis X. As shown, in FIGS. 9 and 10, the engaging groove 283*a* engages an engaging pin 220*a* mounted to the second base member 220. As a result, the moving direction of the locking member 283 is restricted such that the locking member 283 is movable only in a right-left direction in FIGS. 9 and 10.

Figure 9:
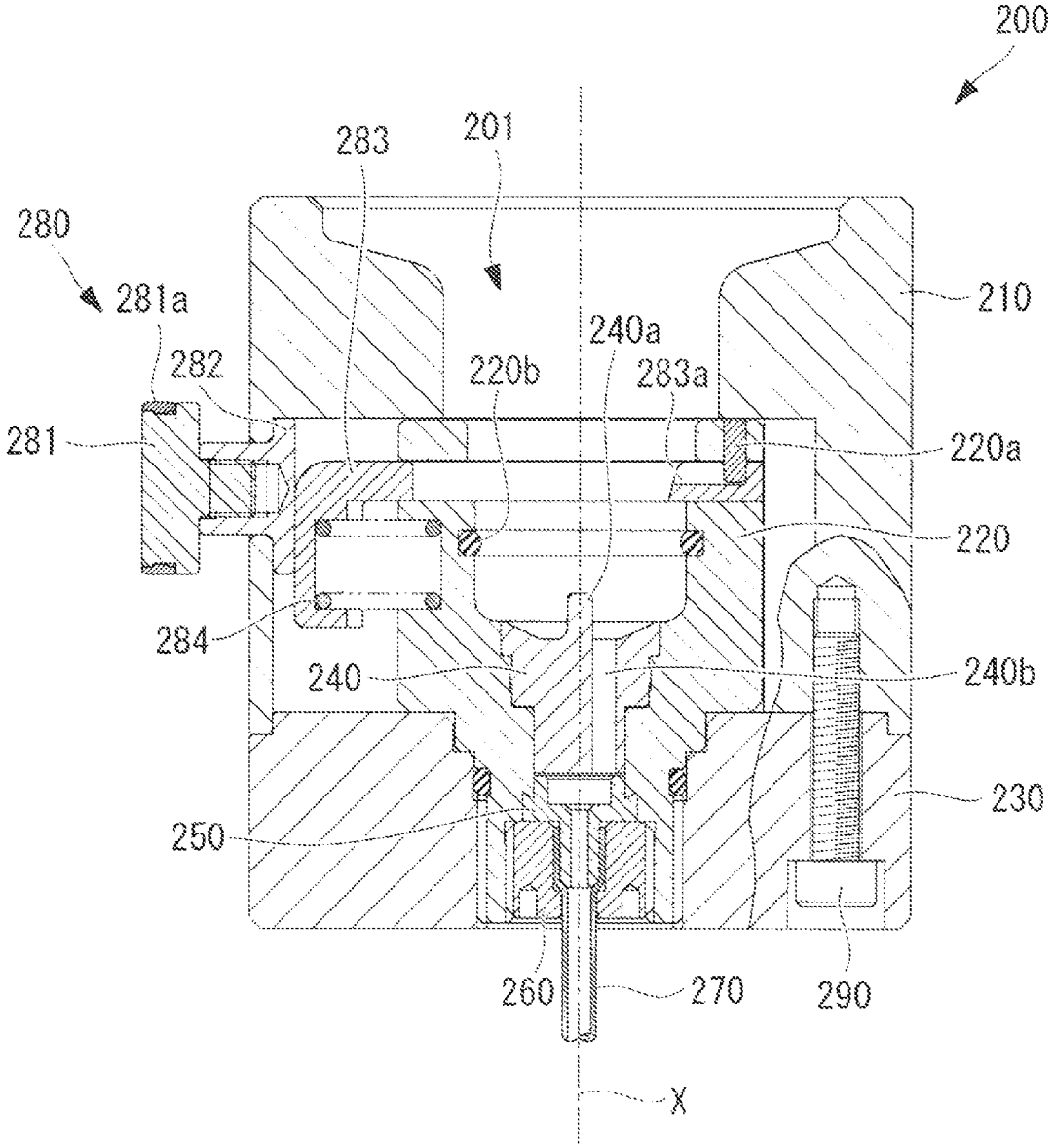
FIG. 9 is a vertical cross-sectional view showing a server device of the first embodiment showing the server device in a locked state.
Figure 10:
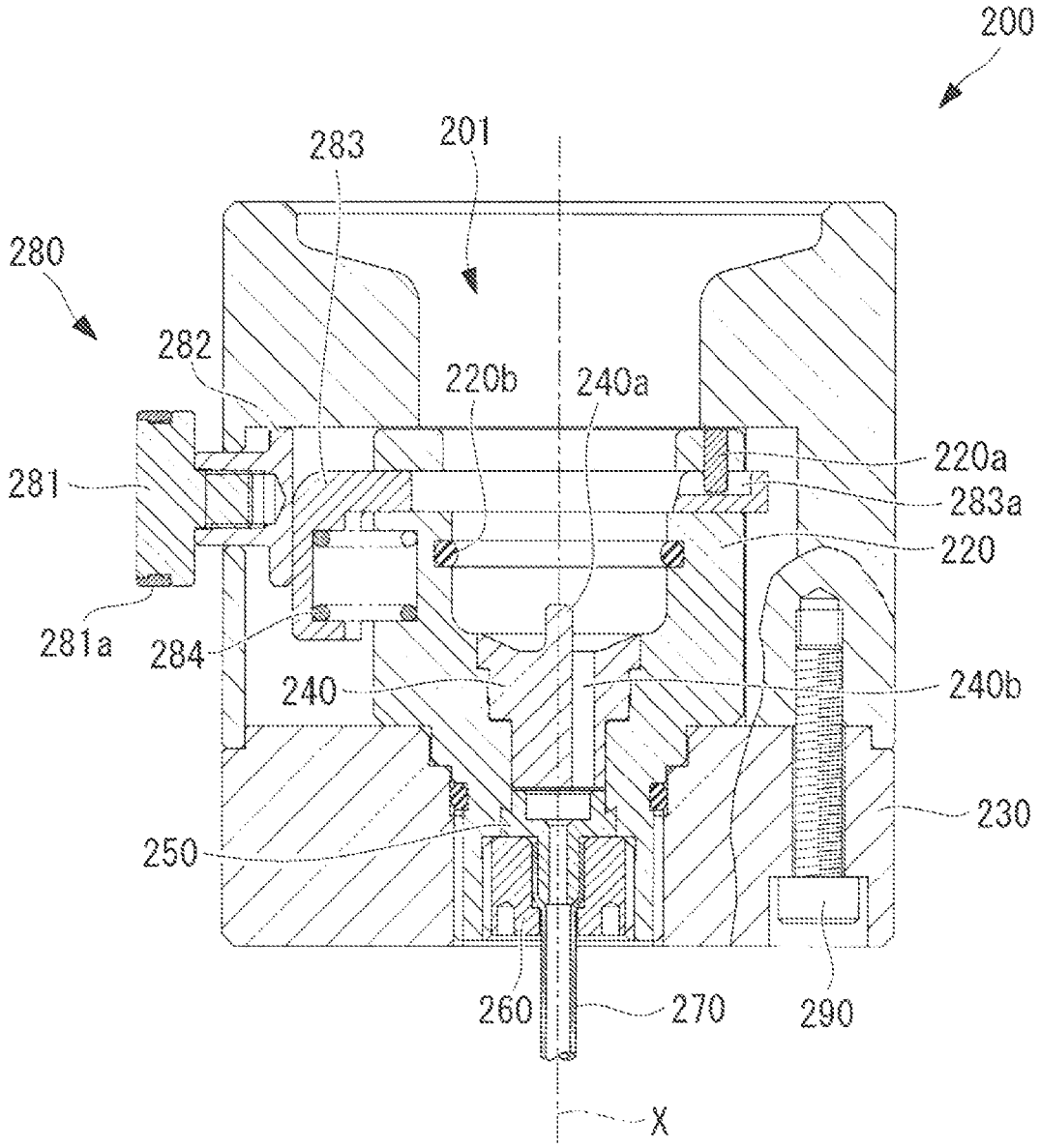
FIG. 10 is a vertical cross-sectional view showing the server device of the first embodiment showing the server device in an unlocked state.

As shown in FIGS. 9 and 10, the spring 284 exerts a biasing force on the locking member 283 in a direction in which the locking member 283 is pressed against the pressing member 282. When the operator is not holding down the unlocking button 281, the locking member 283 is pressing the pressing member 282 leftward as in FIGS. 9 and 10 into the state shown in FIG. 9. FIG. 9 shows the same state as that in FIG. X, where the locking member 283 projects into the recess 201. In this state, the locking member 283 projecting into the recess 201 engages a locking groove 12*c* (refer to FIG. 2) formed on the outer circumferential surface of the reduced-diameter portion 12. The locked state is established where the reduced-diameter portion 12 is fixed to the recess 201 as the locking member 283 engages the locking groove 12*c*.

When the operator is holding down the unlocking button 281, the pressing member 282 is pressing the locking member 283 rightward as in FIGS. 9 and 10 into the state shown in FIG. 10. In the state shown in FIG. 10, the locking member 283 does not project into the recess 201. In this state, the locking member 283 does not engage the locking groove 12*c* (refer to FIG. 2) formed on the outer circumferential surface of the reduced-diameter portion 12. Because the locking member 283 is not engaged with the locking groove 12*c*, the unlocked state is established where the reduced-diameter portion 12 is removable from the recess 201.

Next, a method for manufacturing the valve-integrating container 100 of the embodiment will be described.

The container body 10 of the valve-integrating container 100 of the embodiment is formed by heat welding a lower end side container including the first enlarged-diameter portion 11*a*, the reduced-diameter portion 12, and the connecting portion 13 and an upper end side container including the second enlarged-diameter portion 11*b* and the opening portion 14.

Figure 11:
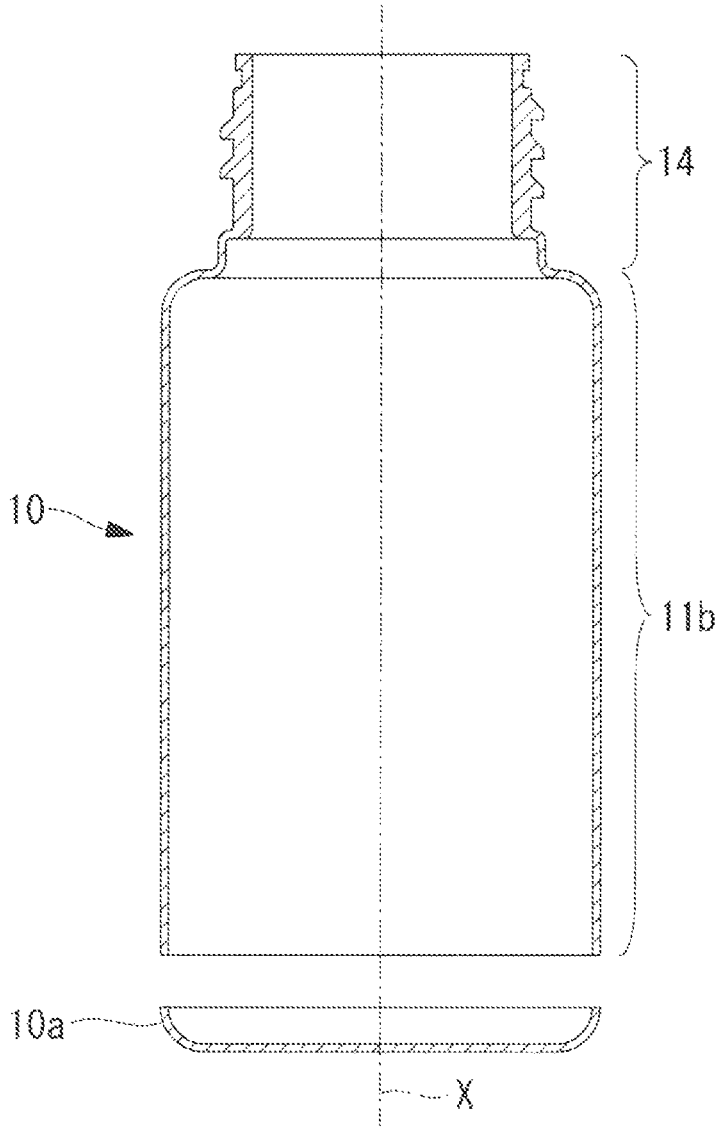
FIG. 11 shows a step of forming an upper end side container of the valve-integrating container shown in FIG. 11.

In the method for manufacturing the valve-integrating container 100 of the embodiment, each of the upper end side container and the lower end side container is formed first. As shown in FIG. 11, the upper end side container is formed by cutting off a base portion 10*a* from a container having a base at its lower end. As shown in FIG. 11, the container body 10 with the base portion 10*a* cut off includes the second enlarged-diameter portion 11*b* and the opening portion 14.

Also, in the method for manufacturing the valve-integrating container 100 of the embodiment, the lower end side container including the first enlarged-diameter portion 11*a*, the reduced-diameter portion 12, and the connecting portion 13 is formed by injection molding a resin material, for example.

Figure 12:
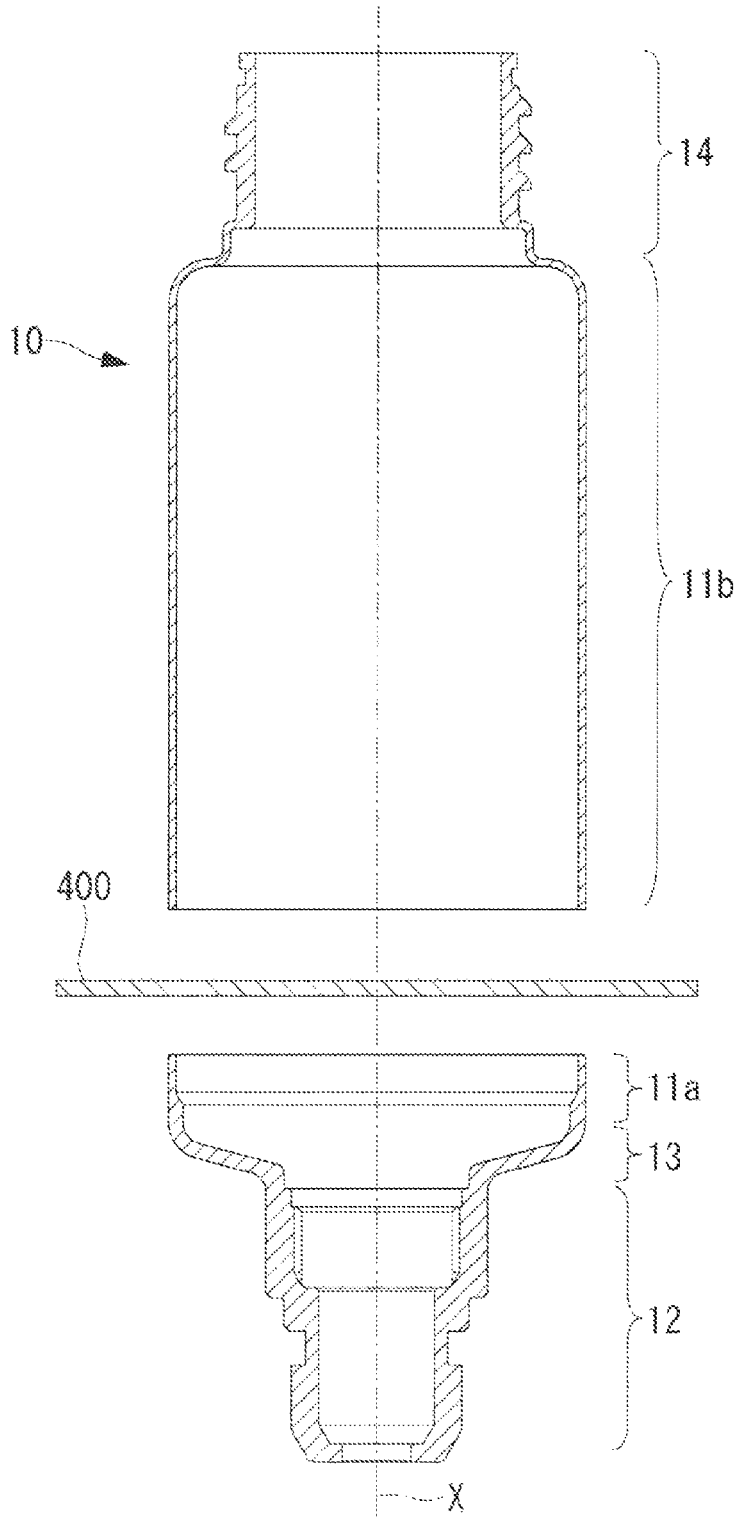
FIG. 12 is a vertical cross-sectional view showing the upper end side container and a lower end side container of the valve-integrating container shown in FIG. 1 before the upper and lower end side containers are joined together.

In the method for manufacturing the valve-integrating container 100 of the embodiment, after the upper end side container and the lower end side container are formed, the both containers are positioned as shown in FIG. 12. In FIG. 12, a lower end surface of the upper end side container and an upper end surface of the lower end side container are spaced from each other, and a heater plate 400 is placed the clearance therebetween. The heater plate 400 is heated by a heat source (not shown). The lower end surface of the upper end side container and the upper end surface of the lower end side container become melted at their end surfaces close to the heater plate 400 due to the radiant heat from the heater plate 400.

Figure 13:
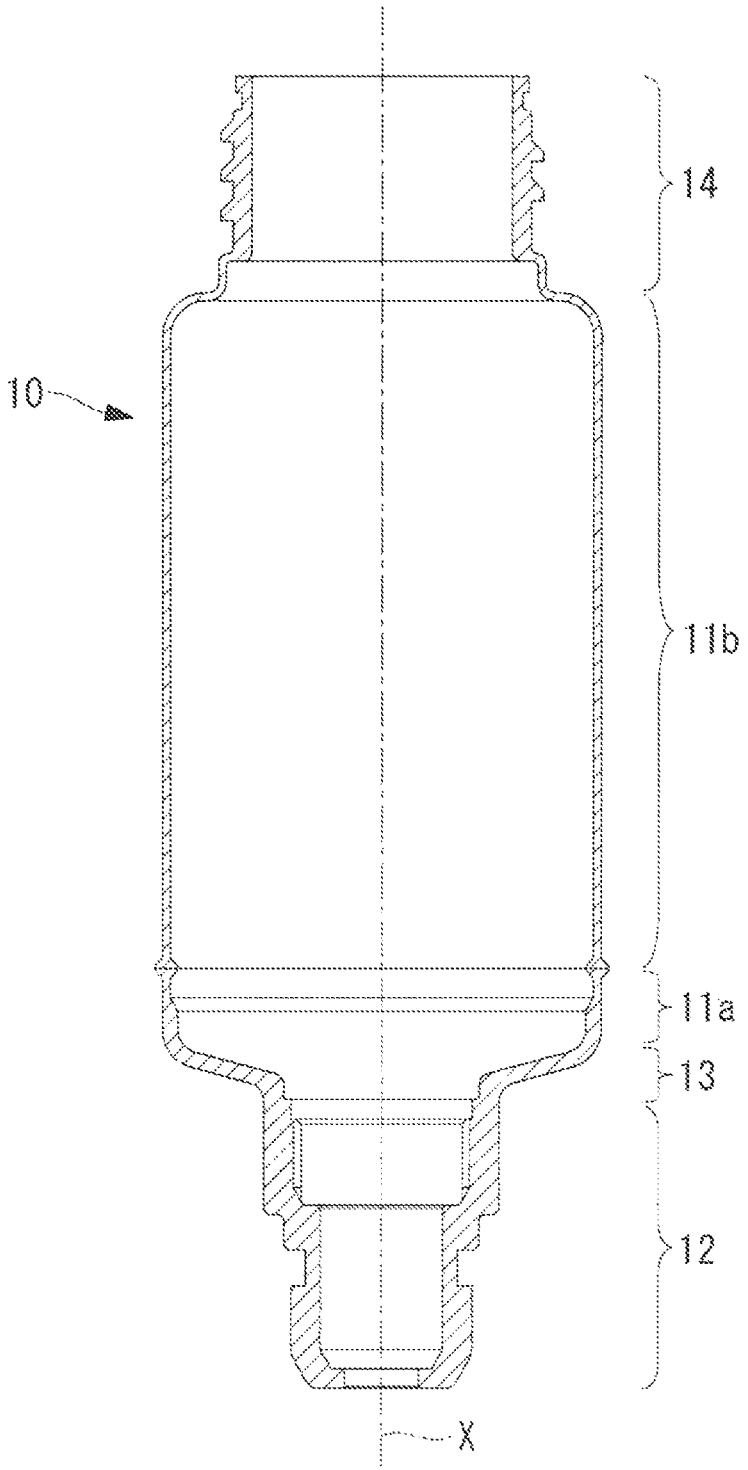
FIG. 13 is a vertical cross-sectional view showing the upper end side container and the lower end side container of the valve-integrating container shown in FIG. 1 after the upper and lower end side containers are joined together.

After the resin materials of the lower end surface of the upper end side container and the upper end surface of the lower end, side container are melted in the state shown in FIG. 12, the heater plate 400 is removed from the clearance between the lower end surface of the upper end side container and the lower end side container. Then, the lower end surface of the upper end side container and the tipper end surface of the lower end side container whose resin materials are melted are brought close to each other along the axis X and into contact with each other. As shown in FIG. 13, after the lower end surface of the upper end side container and the upper end surface of the lower end side container are left contacted to each other for a period of time, the melted resin materials of the lower end surface of the upper end side container and the upper end surface of the lower end side container solidify to be joined to each other. The container body 10 is formed in this way.

After forming the container body 10 shown in FIG. 13, the valve mechanism 20 is inserted into the container body 10 from above the opening portion 14, and the external threads formed on the lower end portion 22*b* of the valve mechanism 20 are fastened to the internal threads formed on the inner circumferential surface of the reduced-diameter portion 12. The worker inserts a jig from the opening portion 14 to rotate the valve mechanism 20 about the axis X, thereby mounting the valve mechanism 20 to the reduced-diameter portion 12.

After mounting the valve mechanism 20 to the reduced-diameter portion 12, the worker fastens the cap 30 carrying the internal threads 30*a* on its inner circumferential surface to external threads 14*a* provided on the outer circumferential surface of the opening portion 14.

The valve-integrating container 100 shown in FIG. 2 is manufactured by the above series of work.

The operations and effects of the embodiment as described above will be described.

According to the valve-integrating container 100 of the embodiment, the valve mechanism 20 switching whether the liquid stored in the container body 10 is allowed to flow out is mounted to the reduced-diameter portion 12 provided at a lower portion of the container body 10. The spring 21 exerts a biasing force on the valve plug 23 of the valve mechanism 20 in a direction toward the opening portion 12*a* provided at the lower-end of the reduced-diameter portion 12. The spring supporting part 22 supporting the one end portion 21*a* of the spring 21 is mounted at the lower end portion 22*b* to the internal threads 12*b* on the inner circumferential surface of the reduced-diameter portion 12 and projects at the upper end portion 22*c* toward the enlarged-diameter portion 11 of the container body 10. This shortens the length of the valve-integrating container 100 along the axis X to downside it as compared with the case where the spring supporting part 22 does not project toward the enlarged-diameter portion 11 of the container body 10.

If the level of the liquid, stored in the container body 10 is higher than the upper end of the spring supporting part 22 projecting toward the enlarged-diameter portion 11, the liquid is led to the opening portion 12*a* by the liquid flow channel 22*a* formed in the spring supporting part 22. Meanwhile, if the level of the liquid stored in the container body 10 is lower than the upper end of the spring supporting part 22 projecting toward the enlarged-diameter portion 11, the liquid does not flow through, the liquid flow channel 22*a* formed in the spring supporting part 22.

According to the valve-integrating container 100 of the embodiment, the liquid stored, at the connecting portion 13 connecting the enlarged-diameter portion 11 and the reduced-diameter portion 12 of the container body 10 is guided downwardly in the direction of the axis X by the guide grooves 22*d* formed on the outer circumferential surface of the spring supporting part 22 whether the level of the liquid is higher or lower than the upper end of the spring supporting part 22. Also, the liquid guided by the guide grooves 22*d* will be led by the guide grooves 23*a* formed on the outer circumferential surface of the valve plug 23 to the opening portion 12*a*.

According to the valve-integrating container 100 of the embodiment, by mounting the valve-integrating container 100 to, for example, the server device 200 having the projection, portion 240*a* moving the valve plug 23 away from the opening portion 12*a*, the worker can easily and safely withdraw the liquid inside the container body 10 without, touching the liquid.

Thus, according to the valve-integrating container 100 of the embodiment, there can be provided a downsized, valve-integrating container 100 which enables a liquid inside a container to be withdrawn easily and safely without leaving any residue.

The valve-integrating container 100 of the embodiment includes the filter part 40, which is attached to the upper portion of the container body 10 and lets a gas flow into and out of the container body 10, while preventing a liquid from flowing into and out of the container body 10.

According to the embodiment, because the filter part 40 lets a gas flow into and out of the container body 10, a gas can be led into the container body 10 from the outside for volume displacement of a liquid having flowed out through the opening portion 12*a*. In addition, a gas generating inside the container body 10, for example, is discharged to the outside, thereby avoiding high pressure inside the container body 10. Further, the filter part 40 prevents a liquid or foreign matter having a particle diameter larger than that of a liquid from entering into the container body 10 from outside while preventing a liquid from flowing out of the container body 10.

In the embodiment, the container body 10 has the cylindrical opening portion 14 which is provided above the enlarged-diameter portion 11, extends along the axis X, and carries the external threads 14*a* on its cater circumferential surface. The container body 10 includes the cap 30 carrying on its inner circumferential surface the internal threads 30*a* to be fastened to the external threads 14*a* formed on the opening portion 14. The filter part 40 is attached to the cap 30.

With this configuration, a liquid can be easily supplied into the container body 10 through the opening portion 14 with the cap 30 removed from the container body 10. Also, an easy operation of attaching the cap 30 to the container body 10 can make the filter part 40 attached to the opening portion 14.

In the embodiment, the enlarged-diameter portion 11 includes the first enlarged-diameter portion 11*a* integrally molded with the reduced-diameter portion 12 and the connecting portion 13 and the second enlarged-diameter portion 11*b* provided above the first enlarged-diameter portion 11*a*. The upper end of the first enlarged-diameter portion 11*a* is joined to the lower end of the second enlarged-diameter portion 11*b* by heat welding.

With this configuration, the container body 10 can be formed by joining by heat, welding a member prepared by integrally molding the reduced-diameter portion 12, the connecting portion 13, and the first enlarged-diameter portion 11*a*, and a member forming the second enlarged-diameter portion 11*b*. Accordingly, the container body 10 can be manufactured easily compared with integrally molding all of the reduced-diameter portion 12, the connecting portion 13, and the enlarged-diameter portion 11 as a single member.

According to the liquid withdrawing device 300 of the embodiment, the reduced-diameter portion 12 of the container body 10 is locked as it is fixed in the recess 201 in response to insertion of the valve-integrating container 100 into the recess 201 of the server device 200. Also, the tip portion 23*b* of the valve plug 23 of the valve-integrating container 100 contacts the projection portion 240*a* of the server device 200 to be moved away from the opening portion 12*a*, and thus the liquid stored in the valve-integrating container 100 can be withdrawn through the opening portion 12*a*.

With this configuration, there can be provided a liquid withdrawing device 300 equipped with the downsized valve-integrating container 100 which enables a liquid inside the container to be withdrawn easily and safely without leaving any residue.

According to the method for manufacturing the valve-integrating container 100 of the embodiment, the base portion 10*a* is cut off from the container having the opening portion 14 at the upper end side and the base at the lower end side, thereby forming the upper end side container having the second enlarged-diameter portion 11*b* at the lower portion. Thus, the upper end side container can be formed from a container of a commonly used shape.

Also, the upper end of the first enlarged-diameter portion 11*a* of the lower end side container and the lower end of the second enlarged-diameter portion 11*b* of the upper end side container are joined together by heat, welding, and after that the valve mechanism 20 is inserted through the opening portion 14 of the upper end side container to be mounted, to the reduced-diameter portion 12 of the lower end side container. This prevents the valve mechanism 20 from contacting the heat source when joining the upper end side container to the lower end side container by heat welding. In addition, the valve mechanism 20 is mounted to the lower end side container, the liquid is poured into the container body 10, and then the cap 30 is fastened, and thus this seals the liquid in the valve-integrating container 100.

Second Embodiment

Next, a second embodiment of the present disclosure will be described with reference to drawings.

The second embodiment is a modification of the first embodiment, and is similar to the first embodiment unless otherwise described hereinafter.

In the valve-integrating container 100 of the first embodiment, the cap 30 is attached to the upper portion of the container body 10. On the other hand, in a valve-integrating container 100' of the second embodiment, the container body 10 has at its upper end side a reduced-diameter portion 12', an enlarged-diameter portion 11*c*, and a connecting portion 13' while having a valve mechanism 20' mounted to an inner circumferential surface of the reduced-diameter portion 12'.

Figure 14:
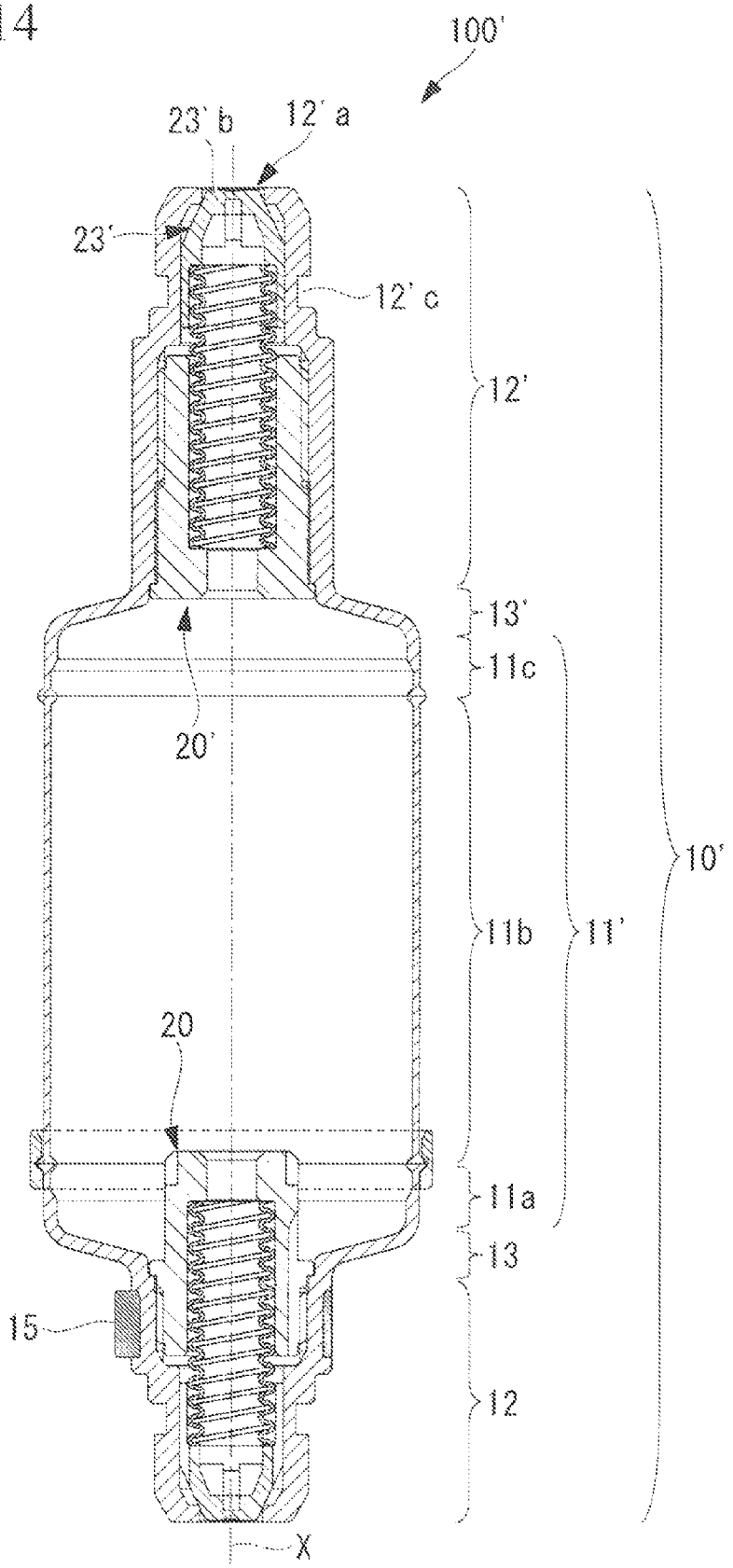
FIG. 14 is a vertical cross-sectional view showing a valve-integrating container in a second embodiment.

As shown in FIG. 14, a container body 10' of the embodiment includes an enlarged-diameter portion 11', a reduced-diameter portion 12, the connecting portion 13, the reduced-diameter portion 12', and the connecting portion 13' and stores a liquid inside. The container body 10' is formed in a cylindrical shape extending along the axis X. The reduced-diameter portion 12' is provided above the enlarged-diameter portion 11' and connected to the enlarged-diameter portion 11' by the connecting portion 13'.

In the valve-integrating container 100', a valve mechanism 20 mounted to the reduced-diameter portion 12 projects toward the enlarged-diameter portion 11', while the valve mechanism 20' mounted to the reduced-diameter portion 12' does not project toward the enlarged-diameter portion 11' but is accommodated inside the reduced-diameter portion 12'. This is in order not to leave the valve mechanism 20' projecting toward the enlarged-diameter portion 11' when joining the enlarged-diameter portions 11*c* and 11*b* by heat welding.

Here, the structure of the valve mechanism 20' is similar to that of the valve mechanism 20 described in the first embodiment and the description thereof will be omitted.

Figure 15:
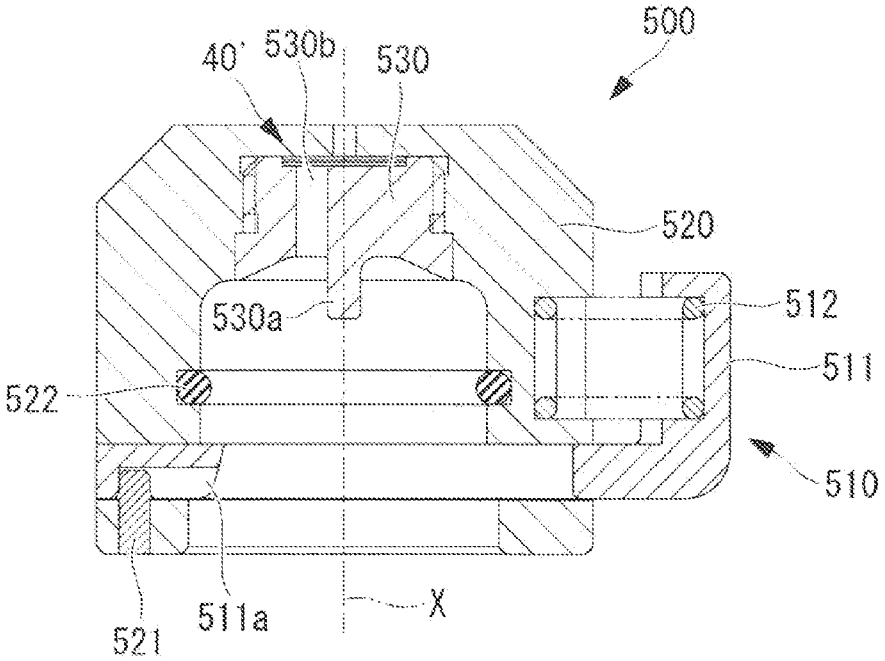
FIG. 15 is a vertical cross-sectional view showing an example of a socket attached to an upper end of the valve-integrating container shown in FIG. 14.
Figure 16:
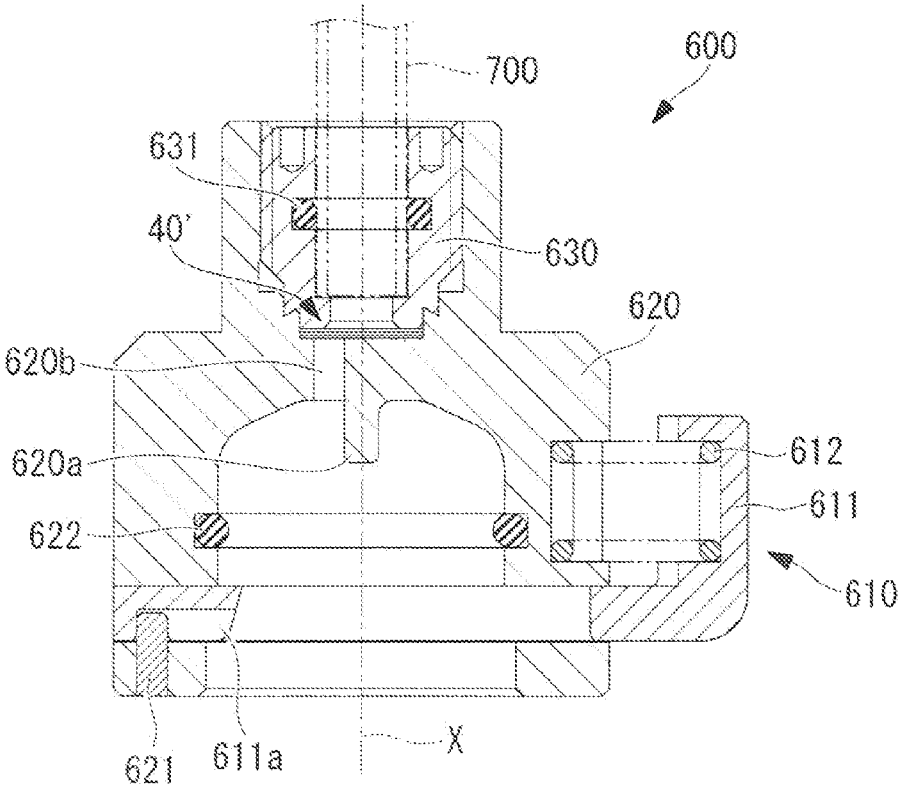
FIG. 16 is a vertical cross-sectional view showing another example of the socket attached to the upper end of the valve-integrating container shown in FIG. 14.

A socket 500 shown in FIG. 15 or a socket 600 shown in FIG. 16 is attached to the reduced-diameter portion 12' shown in FIG. 14.

The socket 500 shown in FIG. 15 can maintain the inside of the container body 10' at atmospheric pressure. The socket 500 lets a gas flow into and out of the container body 10' in response to a change in the volume of the liquid in the container body 10', thereby maintaining the inside of the container body 10' at atmospheric pressure. In addition, according to the socket 500, a gas generated from the liquid in the container body 10' would flow out of the container body 10', thereby inhibiting pressurization of the container body 10' due to the gas.

The socket 500 shown in FIG. 15 and the socket 600 shown in FIG. 16 are different in that the socket 600 can let a gas (e.g., a nitrogen gas) from an external gas supply source (not shown) flow into the container body 10' by installing a tube 700 (a member indicated by a dashed line in FIG. 16).

With a socket 600 provided with the tube installed thereto, a gas is supplied from the gas supply source in response to a change in the volume of the liquid in the container body 10', thereby maintaining the inside of the container body 10' at an appropriate pressure.

A socket 600 not provided with the tube installed thereto have similar functions as those of the socket 500, and can maintain the inside of the container body 10' at atmospheric pressure.

The socket 500 shown in FIG. 15 includes a locking mechanism 510, a socket body 520, and a valve pressing member 530.

The locking mechanism 510 establishes a locked state where the reduced-diameter portion 12' of the container body 10' is fixed to the socket body 520 in response to insertion of the reduced-diameter portion 12' of the container body 10' into the socket body 520 and establishes an unlocked state where the reduced-diameter portion 12' is removable from the socket body 520 in response to the operator's unlocking operation.

The locking mechanism 510 includes a locking member 511 and a spring 512.

The locking member 511 is generally formed in a ring shape and is placed around the axis X. The locking member 511 has on its lower end surface an engaging groove 511*a* extending in a radial direction orthogonal to the axis X. As shown in FIG. 15, the engaging groove 511*a* engages an engaging pin 521 mounted, to the socket body 520. As a result, the moving direction of the locking member 511 is restricted such that the locking member 511 is movable only in a right-left direction in FIG. 15.

A biasing force is exerted by the spring 512 on the locking member 511 in a direction from the left to the right in FIG. 15. When the locking member 511 is not held down, the locking member 511 is pressed in the right direction as in FIG. 15, to project beyond an inner circumferential surface of the socket body 520. In this state, the locking member 511 projecting beyond the inner circumferential surface of the socket body 520 engages a locking groove 12'*c* (refer to FIG. 14) formed on an outer circumferential surface of the reduced-diameter portion 12'. Because the locking member 511 engages the locking groove 12'*c*, the locked state is established where the reduced-diameter portion 12' is fixed to the socket 500.

When the operator is holding down the locking member 511, the locking member 511 does not project beyond the inner circumferential surface of the socket body 520. In this state, the locking member 511 is not engaged with the locking groove 12'*c* (refer to FIG. 14) formed on the outer circumferential surface of the reduced-diameter portion 12'. Because the locking member 511 is not engaged with the locking groove 12'*c*, the unlocked state is established where the reduced-diameter portion 12' is removable from the socket body 520.

The valve pressing member 530 is shaped generally in a cylinder carrying at its outer circumferential surface external threads to be fastened to internal threads formed, on the inner circumferential surface of the socket body 520. The valve pressing member 530 is mounted, to the socket body 520 as its external threads formed on the outer circumferential surface are fastened to the internal threads of the socket body 520.

The valve pressing member 530 has a projection portion 530*a* to press a tip portion 23'*b* of a valve plug 23' of the valve mechanism 20' downwardly along the axis X. When the reduced-diameter portion 12*f* is inserted in the socket body 520, the projection portion 530*a* contacts the tip portion 23'*b* of the valve plug 23' to move the valve plug 23' away from, the opening portion 12'*a*.

The valve pressing member 530 has liquid flow channels 530*b* penetrating therethrough in the direction of the axis X, at a plurality of points around the axis X. When the valve plug 23' is away from the opening portion 12'*a*, a gas can flow into and out of the container body 10'.

The socket 500 includes a filter part 40' between the socket body 520 and the valve pressing member 530. The filter part 40' has a structure similar to that of the first embodiment where the membrane filter 40*a* is sandwiched between the coarse filters 40*b*. The filter part 40' lets a gas flow into and out of the container body 10', while preventing a liquid from flowing into and out of the container body 10'.

The socket body 520 has on its inner circumferential surface an endless groove portion extending around the axis X, and an O ring 522 is attached to the groove portion. When the reduced-diameter portion 12' of the container body 10' is inserted in the socket body 520, the O ring 522 contacts the outer circumferential surface of the reduced-diameter portion 12' to form a seal area along the entire circumference around the axis X.

The socket 600 shown in FIG. 16 includes a locking mechanism 610, a socket body 620, and a connecting member 630.

The locking mechanism 610 establishes a locked state where the reduced-diameter portion 121 of the container body 10' is fixed to the socket body 620 in response to insertion of the reduced-diameter portion 12' into the socket body 620 and establishes an unlocked state where the reduced-diameter portion 12' is removable from the socket body 620 in response to the operator's unlocking operation.

The locking mechanism 610 includes a locking member 611 and a spring 612.

The locking member 611 has on its lower end surface an engaging groove 611*a* extending in a radial direction orthogonal to the axis X. As shown in FIG. 16, the engaging groove 611*a* engages an engaging pin 621 mounted to the socket body 620. As a result, the moving direction of the locking member 611 is restricted such that the locking member 611 is movable only in a right-left direction in FIG. 16.

Here, the locking mechanism 610 of FIG. 16 has a structure similar to that of the locking mechanism 510 in FIG. 15, and the description thereof will be omitted.

The socket body 620 has a projection portion 620*a* to press the tip portion 23'*b* of the valve plug 23' of the valve mechanism 20' downwardly along the axis X. When the reduced-diameter portion 12' is inserted in the socket body 620, the projection portion 620*a* contacts the tip portion 23'*b* of the valve plug 23' to move the valve plug 23' away from the opening portion 12'*a*.

The socket body 620 has liquid flow channels 620*b* penetrating therethrough in the direction of the axis X, at a plurality of points around the axis X. When the valve plug 23' is away from the opening portion 12'*a*, gas can flow into and out of the container body 10'.

The socket body 620 has the connecting member 630 mounted to its upper end portion. The connecting member 630 connects the socket body 620 to piping (not shown). The piping is inserted into the connecting member 630 to be fixed to the connecting member 630. When the tube 700 is connected to the connecting member 630, a gas can flow into the socket body 620 from the external gas supply source (not shown).

The connecting member 630 has on its inner circumferential surface an endless groove portion extending around the axis X. An O ring 631, which is a ring-shaped elastic member extending around the axis X, is attached to the groove portion. The O ring 631 contacts an outer circumferential surface of the tube 700 to form a seal area along the entire circumference around the axis X.

The socket 600 includes a filter part 40' between the socket body 620 and the connecting member 630. The filter part 40' has a structure similar to that shown in FIG. 15 and similar to the configuration in which the membrane filter 40*a* is sandwiched between the coarse filters 40*b* as in the first embodiment. The filter part 40' lets a gas flow into and out of the container body 10', while preventing a liquid from flowing into and out of the container body 10'.

The socket, body 620 has on its inner circumferential surface an endless groove portion extending around the axis X, and an O ring 622 is attached to the groove portion. When the reduced-diameter portion 12' of the container body 10' is inserted in the socket body 620, the O ring 622 contacts the outer circumferential surface of the reduced-diameter portion 12' to form a seal area along the entire circumference around the axis X.

Next, a structure for preventing misconnection between the valve-integrating container 100' and the server device 200' will be described using FIG. 17 and FIG. 18.

Figure 17:
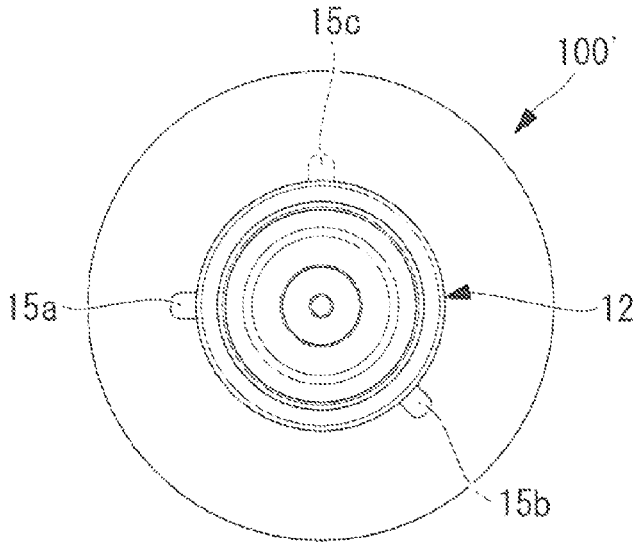
FIG. 17 is a plan view of the valve-integrating container shown in FIG. 14 as seen from below in the axial direction.

As shown in FIG. 17, a misconnection preventing ring 15 is attached to the outer circumferential surface of the reduced-diameter portion 12 of the valve-integrating container 100' of the embodiment. The misconnection preventing ring 15 has projection portions 15*a* and 15*b* extending in the direction of the axis X at two points around the axis X.

Meanwhile, a recess 201 of the server device 200' to which the valve-integrating container 100' is mounted has on its inner circumferential surface groove portions 211 and 212 extending in the direction of the axis X, at a plurality of points around the axis X. It is to be noted that the server device 200' of the embodiment has a structure similar to that of the server device 200 of the first embodiment except that the groove portions 211 and 212 are formed.

Figure 18:
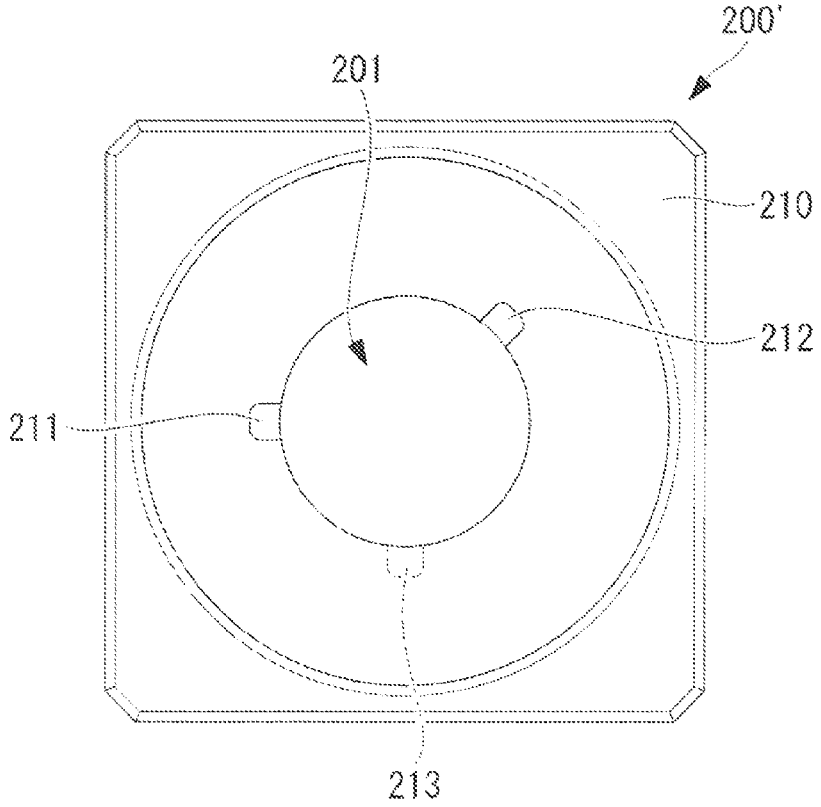
FIG. 18 is a plan view of a server device of the second embodiment as seen from above in the axial direction.

As shown in FIG. 18, the positions of the groove portions 211 and 212 around the axis X correspond to those of the projection portions 15*a* and 15*b* shown in FIG. 17 around the axis X. Accordingly, in mounting the valve-integrating container 100' to the server device 200', the projection portion 15*a* is inserted into the groove portion 211, and the projection portion 15*b* is inserted into the groove portion 212. The valve-integrating container 100' is mounted to the server device 200' in this way.

The valve-integrating container 100' is provided with the projection portions 15*a* and 15*b* and the server device 200' is provided with the groove portions 211 and 212 in order to prevent misconnection. When withdrawing multiple liquids using a plurality of server devices 200', different valve-integrating containers 100' stores different liquids. In this case, each valve-integrating container 100' needs to be mounted to its corresponding appropriate server device 200'. However, misconnection can occur in which a valve-integrating container 100' is mounted to a server device 200' not corresponding to the valve-integrating container 100'.

Thus in the embodiment, the valve-integrating container 100' is provided with, the projection portions 15*a* and 15*b*, and the server device 200' is provided with the groove portions 211 and 212 in order to provide a one to one correspondence between the valve-integrating containers 100' and the server devices 200'.

For example, a projection portion 15*c* may foe provided instead of the projection portion 15*b* shown in FIG. 17, and a groove portion 213 may be provided instead of the groove portion 212 shown in FIG. 18. This can provide another pair of a valve-integrating container 100' and a server device 200' which is different from the pair of the valve-integrating container 100' and the server device 200' shown in FIGS. 17 and 18.

According to the embodiment, the projection portions 15*a* and 15*b* cannot be inserted into the groove portions 211 and 212 when the positions of the groove portions 211 and 212 around the axis X do not correspond to those of the projection portions 15*a* and 15*b* around the axis X, preventing the valve-integrating container 100' from being mounted to the server device 200'. Therefore, in situations in which there are a plurality of valve-integrating containers 100' each containing a different liquid and their respective server devices 200', misconnection between the valve-integrating containers 100' and the server devices 200' can be prevented.

Third Embodiment

Next, a third embodiment of the present disclosure will be described with reference to the drawings.

The third embodiment is a modification of the first embodiment and is similar to the first embodiment unless otherwise described hereinafter.

The third embodiment has a cap 30', a modification of the cap 30 of the first embodiment.

Figure 19:
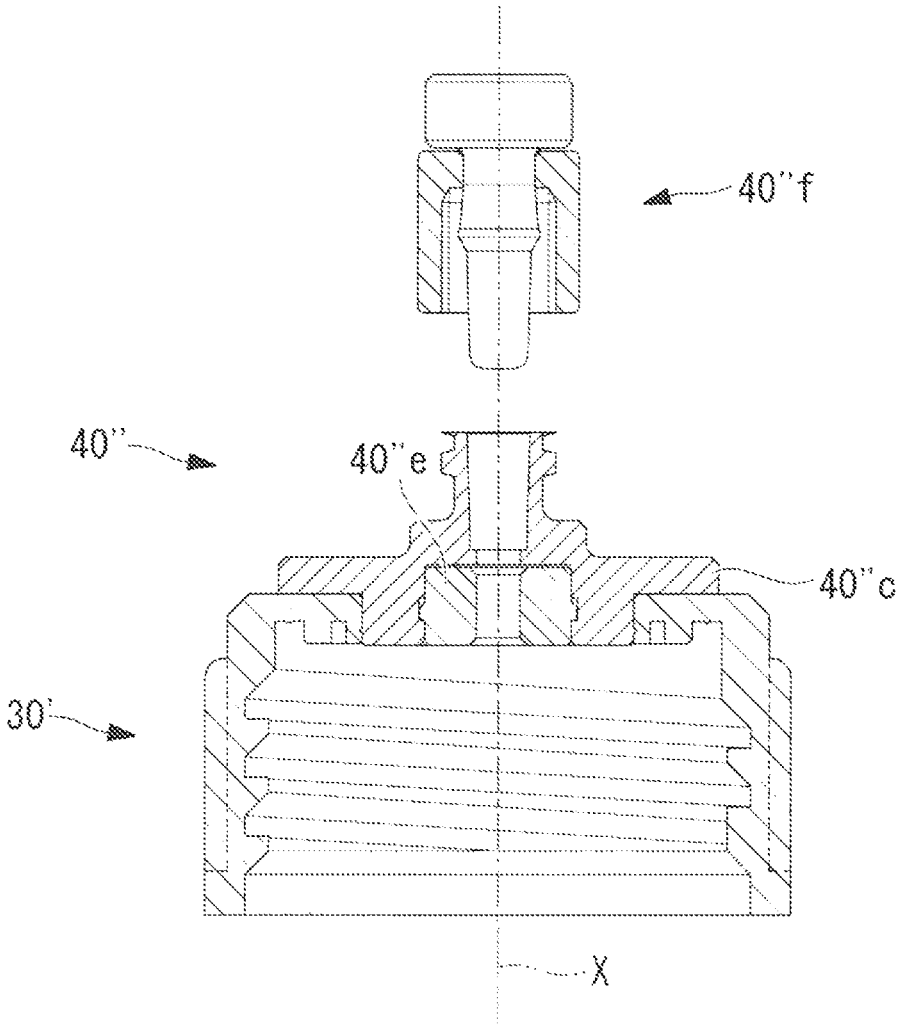
FIG. 19 is a vertical cross-sectional view showing a cap in a third embodiment.

As shown in FIG. 19, the cap 30' of the embodiment has a filter part 40" attached to its upper end surface.

Figure 20:
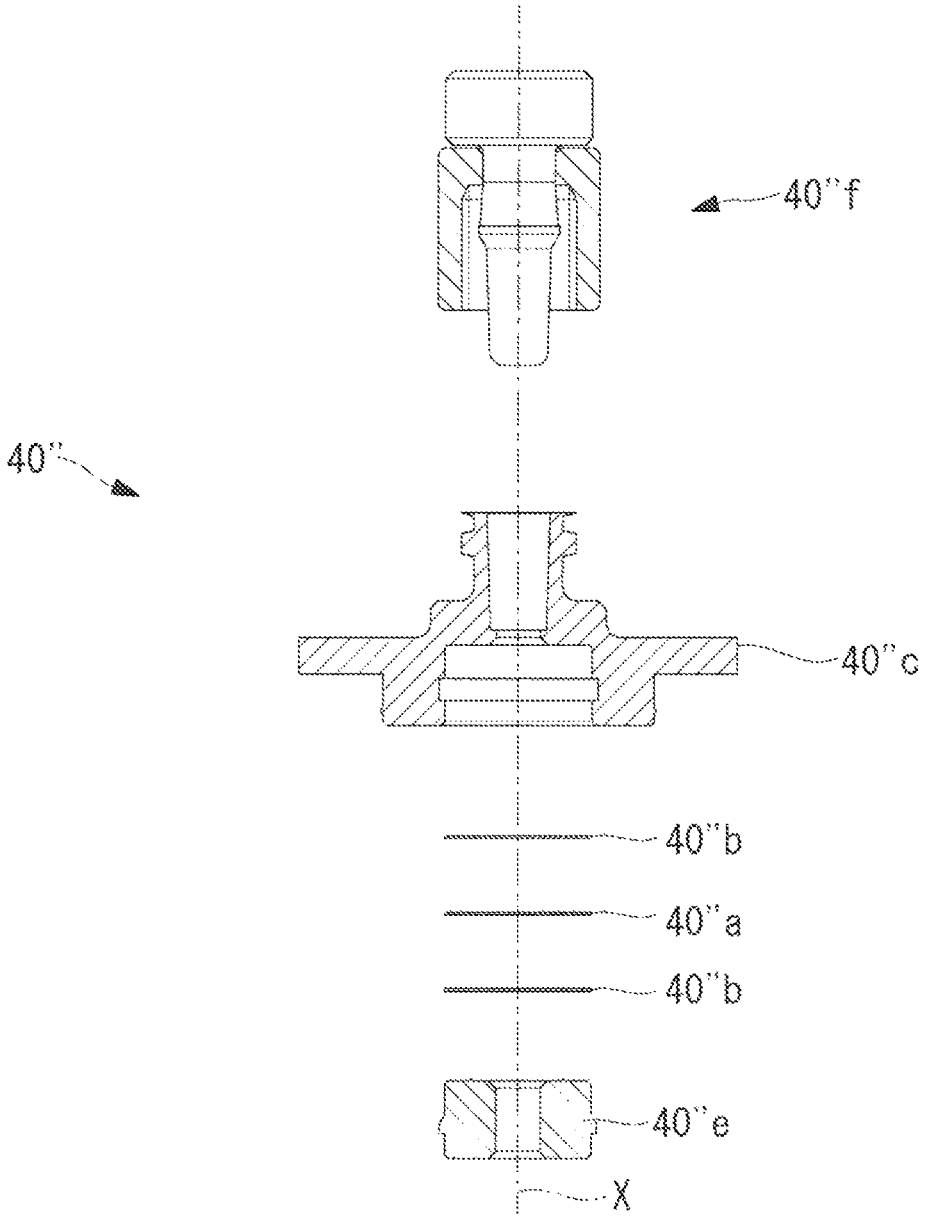
FIG. 20 is an exploded assembly view of a filter part in the third embodiment.

As shown in FIG. 20, the filter part 40" includes a membrane filter 40"*a*, coarse filters 40"*b*, a lid portion 40"*c*, a filter attaching member 40"*e*, and a sealing cap 40"*f*.

The membrane filter 40"*a* and the coarse filters 40'*b* are respectively similar to the membrane filter 40*a* and the coarse filters 40*b* of the first embodiment.

The membrane filter 40"*a* and the coarse filters 40"*b* are placed as they are sandwiched between the lid portion 40"*c* and the filter attaching member 40"*e*. The lid portion 40"*c* is fixed to the cap 30' by, for example, welding.

The lid portion 40"*c* has external threads on its upper portion outer circumferential surface, and the sealing cap 40"*f* with internal threads on its inner circumferential surface is attached to the external threads.

The container body 10 having the cap 30*f* without the sealing cap 40"*f* attached to the cap 30' lets a gas flow into and out of the container body 10 through the filter part 40". Meanwhile, the container body 10 having the cap 30' with the sealing cap 40"*f* attached to the cap 30*f* prevents a gas from flowing into and out of the container body 10 through the filter part 40".

If the sealing cap 40"*f* is not attached to the cap 30', a fitting (e.g., a luer fitting) for connecting piping (not shown) in place of the sealing cap 40"*f* may be attached to the upper portion external threads of the lid portion 40"*c*.

According to the embodiment, gas is prevented from flowing into and out of the container body 10 by attaching the sealing cap 40"*f* to the cap 30', and a gas is let flow into and out of the container body 10 by removing the sealing cap 40" *f* from the cap 30'.

Other Embodiments

The present invention is not limited to the above embodiment, and modifications may be made as appropriate without departing from the scope of the present invention.

The invention claimed is:

1. A valve-integrating container, comprising:

a container body formed in a cylindrical shape extending in an axial direction, the container body having an enlarged-diameter portion, a reduced-diameter portion provided below the enlarged-diameter portion, and a connecting portion connecting the enlarged-diameter portion and the reduced-diameter portion, and a valve mechanism mounted to the reduced-diameter portion of the container body and switching whether a liquid stored in the container body is allowed to flow out through a first opening portion provided at a lower end of the reduced-diameter portion, the valve mechanism including:

a spring disposed along the axial direction;

a spring supporting part supporting one end portion of the spring; and a valve plug disposed between the spring supporting part and the first opening portion and receiving a biasing force toward the first opening portion from an other end portion of the spring, the spring supporting part including:

a liquid flow channel formed in a cylindrical shape extending along the axial direction;

a lower end portion mounted to an inner circumferential surface of the reduced-diameter portion;

an upper end portion projecting toward the enlarged-diameter portion; and a first guide groove formed on an outer circumferential surface thereof for guiding a liquid stored in the connecting portion downwardly in the axial direction, wherein the valve plug has a second guide groove formed on an outer circumferential surface thereof for guiding the liquid guided by the first guide groove, downwardly in the axial direction to the first opening portion.

2. A valve-integrating container according to claim 1, further comprising a filter part attached to an upper portion of the container body, the filter part letting a gas flow into and out of the container body while preventing a liquid from flowing into and out of the container body.

3. A valve-integrating container according to claim 2, wherein the container body includes: a cylindrical second opening portion provided above the enlarged-diameter portion, the second opening portion extending in the axial direction and carrying external threads on an outer circumferential surface thereof; and a cap carrying on an inner circumferential surface thereof internal threads to be fastened to the external threads formed on the second opening portion, and the filter part is attached to the cap.

4. A valve-integrating container according to claim 1, wherein the enlarged-diameter portion includes a first enlarged-diameter portion integrally molded with the reduced-diameter portion and the connecting portion and a second enlarged-diameter portion provided above the first enlarged-diameter portion, an upper end of the first enlarged-diameter portion and a lower end of the second enlarged-diameter portion are joined together by heat welding.

5. A valve-integrating container according to claim 2, wherein the enlarged-diameter portion includes a first enlarged-diameter portion integrally molded with the reduced-diameter portion and the connecting portion and a second enlarged-diameter portion provided above the first enlarged-diameter portion, an upper end of the first enlarged-diameter portion and a lower end of the second enlarged-diameter portion are joined together by heat welding.

6. A valve-integrating container according to claim 3, wherein the enlarged-diameter portion includes a first enlarged-diameter portion integrally molded with the reduced-diameter portion and the connecting portion and a second enlarged-diameter portion provided above the first enlarged-diameter portion, an upper end of the first enlarged-diameter portion and a lower end of the second enlarged-diameter portion are joined together by heat welding.

7. A liquid withdrawing device comprising:

a valve-integrating container according to claim 1; and a server device removably receiving the valve-integrating container and withdrawing the liquid stored in the valve-integrating container, the server device including:

a recess into which the reduced-diameter portion of the container body is inserted;

a projection portion contacting a tip portion of the valve plug when the reduced-diameter portion is inserted in the recess, to move the valve plug away from the first opening portion; and a locking mechanism establishing a locked state where the reduced-diameter portion is fixed to the recess in response to insertion of the reduced-diameter portion into the recess and establishing an unlocked state where the reduced-diameter portion is removable from the recess in response to an operator's unlocking operation.

8. A liquid withdrawing device according to claim 7, wherein the recess of the server device has on an inner circumferential surface thereof groove portions extending in the axial direction at a plurality of points around the axis, the reduced-diameter portion of the valve-integrating container has on an outer circumferential surface thereof projection portions extending in the axial direction at a plurality of points around the axis, a plurality of positions of the groove portions around the axis correspond to a plurality of positions of the projection portions around the axis, and the valve-integrating container is mounted to the server device by inserting the projection portions at the plurality of points into the groove portions at the plurality of points.

9. A method for manufacturing a valve-integrating container comprising the steps of:

forming a lower end side container formed in a cylindrical shape extending in an axial direction and including a first enlarged-diameter portion, a reduced-diameter portion provided below the first enlarged-diameter portion, and a connecting portion connecting the first enlarged-diameter portion and the reduced-diameter portion;

forming an upper end side container having a second enlarged-diameter portion at a lower portion thereof by cutting off a base portion from a container having a second opening portion at an upper end side and a base at a lower end side;

joining by heat welding an upper end of the first enlarged-diameter portion of the lower end side container to a lower end of the second enlarged-diameter portion of the upper end side container;

mounting a valve mechanism switching whether a liquid is allowed to flow out through a first opening portion provided at a lower end of the reduced-diameter portion, to the reduced-diameter portion of the lower end side container by inserting the valve mechanism through the second opening portion; and fastening a cap carrying internal threads on an inner circumferential surface thereof to external threads provided on an outer circumferential surface of the second opening portion.

* * * * *